US006352334B2

(12) United States Patent
Fukushima et al.

(10) Patent No.: US 6,352,334 B2
(45) **Date of Patent: *Mar. 5, 2002**

(54) INK JET PRINTER PROVIDED WITH AN IMPROVED CLEANING UNIT

(75) Inventors: Tatsuya Fukushima, Kawasaki; Masatoshi Ikkatai; Toshiro Sugiyama, both of Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/174,329

(22) Filed: Oct. 19, 1998

(30) Foreign Application Priority Data

| | | |
|---|---|---|
| Oct. 20, 1997 | (JP) | 9-287042 |
| Oct. 22, 1997 | (JP) | 9-307824 |
| Mar. 13, 1998 | (JP) | 10-082872 |
| Mar. 13, 1998 | (JP) | 10-082873 |

(51) Int. Cl.[7] ..... B41J 2/165
(52) U.S. Cl. ..... 347/33; 347/22
(58) Field of Search ..... 347/33, 22, 24, 347/29, 42

(56) References Cited

U.S. PATENT DOCUMENTS

| | | | | | |
|---|---|---|---|---|---|
| 4,998,046 | A | | 3/1991 | Lester | 315/209 |
| 5,051,761 | A | | 9/1991 | Fisher et al. | 346/140 R |
| 5,081,472 | A | | 1/1992 | Fisher | 346/140 |
| 5,103,244 | A | * | 4/1992 | Gast et al. | 347/33 |
| 5,115,250 | A | * | 5/1992 | Harmon et al. | 347/33 |
| 5,515,089 | A | * | 5/1996 | Herko et al. | 347/63 |
| 5,548,309 | A | * | 8/1996 | Okubo et al. | 347/33 |
| 5,608,432 | A | | 3/1997 | Yamaguchi | 347/33 |
| 5,663,751 | A | | 9/1997 | Holbrook | 347/22 |
| 5,907,335 | A | * | 5/1999 | Johnson et al. | 347/28 |
| 5,933,163 | A | * | 8/1999 | Koizumi et al. | 347/42 |
| 5,953,025 | A | * | 9/1999 | Sakurai | 347/33 |

FOREIGN PATENT DOCUMENTS

| | | | | |
|---|---|---|---|---|
| DE | 38 25 046 | | 1/1988 | |
| DE | 44 37 204 | | 3/1996 | |
| EP | 0437361 | | 7/1991 | |
| EP | 0 494 693 | * | 7/1992 | 347/33 |
| EP | 0604068 | | 6/1994 | |
| EP | 0 650 313 | | 4/1995 | |
| EP | 0673772 | | 9/1995 | |
| EP | 0914951 | | 5/1999 | |
| GB | 2 316 246 | | 2/1998 | |
| JP | 57034969 | * | 2/1982 | B41J/3/04 |
| JP | 57-61574 | | 4/1982 | |
| JP | 62113554 | * | 5/1987 | B41J/3/04 |
| JP | 6-340082 | | 12/1994 | |
| JP | 7-9674 | | 1/1995 | |
| JP | 7-52396 | | 2/1995 | |

OTHER PUBLICATIONS

Patent Abstracts of Japan, vol. 011, No. 330 (M–636), Oct. 28, 1987 & JP 62 113858 A (Canon Inc), May 25, 1987 *abstract*.

Patent Abstracts of Japan, vol. 018, No. 065 (M–1554), Feb. 3, 1994 & JP 05 286144 A (Ricoh Co Ltd), Nov. 2, 1993 *abstract*.

(List continued on next page.)

*Primary Examiner*—N. Le
*Assistant Examiner*—Shih-Wen Hsieh
(74) *Attorney, Agent, or Firm*—Fitzpatrick, Cella, Harper & Scinto

(57) ABSTRACT

An ink jet printer comprises a wiper member for wiping the surface of the ink jet recording head. The ink jet recording head and the wiper member move in the same direction each other to wipe the surface of the ink jet recording head by one operation. In this way, the stabilized wiping is always possible to keep the head surface in an appropriate condition of ink discharges, hence obtaining images in beautiful print quality with the stable ink discharges.

29 Claims, 18 Drawing Sheets

OTHER PUBLICATIONS

Patent Abstracts of Japan, vol. 012, No. 126 (M–687), Apr. 19, 1988 & JP 62 251145 A (Canon Inc), Oct. 31, 1987 *abstract*.

Patent Abstracts of Japan, vol. 006, No. 101 (M–135), Jun. 10, 1982 & JP 57 034969 A (Matsushita Electric Ind Co Ltd), Feb. 25, 1982 *abstract*.

Patent Abstracts of Japan, vol. 009, No. 080 (M–379), Apr. 10, 1985 & JP 59 209876 A (Konishiroku Shashin Kogyo KK), Nov. 28, 1984 *abstract*.

Patent Abstracts of Japan, vol. 011, No. 330 (M–636), Oct. 28, 1987 & JP 62 113554 A (Canon Inc), May 25, 1987 *abstract*.

* cited by examiner

FIG. 7A-1
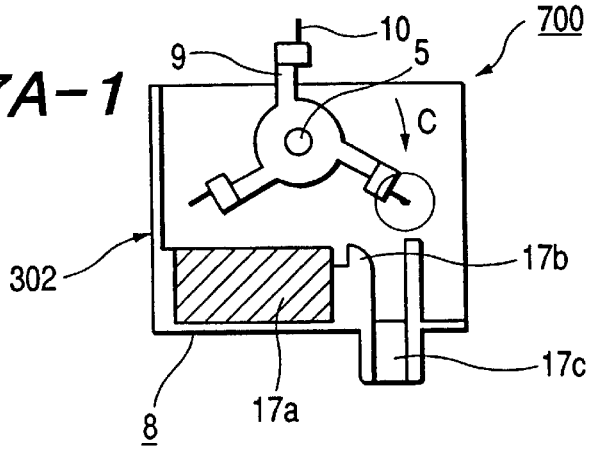
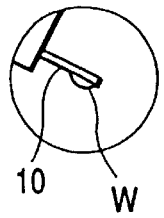
FIG. 7A-2
FIG. 7B-1
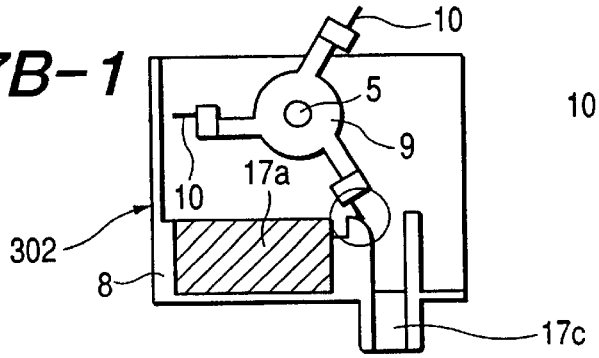
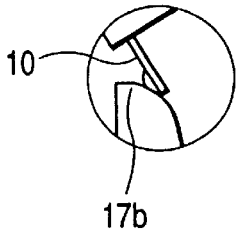
FIG. 7B-2
FIG. 7C-1
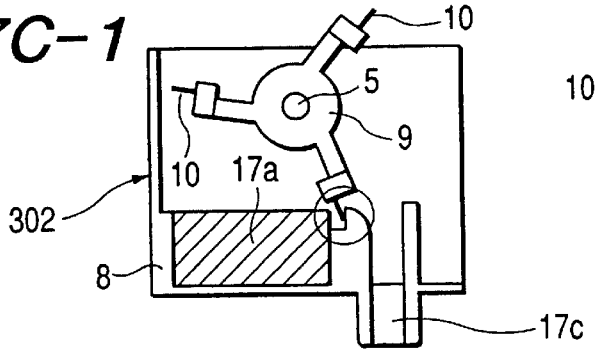
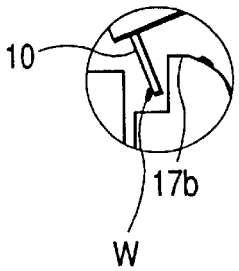
FIG. 7C-2
FIG. 7D
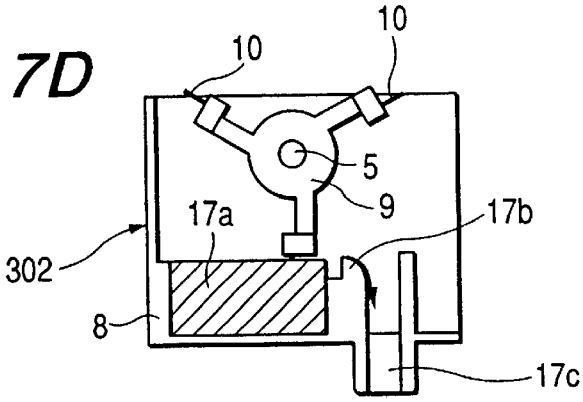

INK JET PRINTER PROVIDED WITH AN IMPROVED CLEANING UNIT

BACKGROUND OF THE INVENTION

1. Field of the Invention

The present invention relates to an ink jet printer that performs recording by discharging ink from the ink jet recording head to a recording medium. More particularly, the invention relates to an ink jet printer provided with a cleaning unit whereby to clean the discharge port surface of the ink jet recording head.

2. Related Background Art

There is a screen printing method, as a typical one, that uses silk screen form plates to print directly on paper for the production of a large poster or a camp. In accordance with this method, each of the silk screen form plates is mounted, at first, on a screen printing apparatus per color corresponding to colors used for the original image to be printed, and then, ink is transferred directly to the paper sheet through meshes of the silk screen form plates for recording.

However, it takes a great number of processes and time to prepare the silk screen form plates in advance. In addition, ink adjustment should be made for each color, and also, each of the silk screen form plates should be positioned, among some other operations needed.

Further, the size of the apparatus is large, and it becomes larger in proportion to the number of colors to be used, which requires not only a larger space for installation of the apparatus, but also, it requires a space for storing the silk screen form plates.

Also, with a printing method of the kind, it is possible to perform a large scale production at extremely low costs, but the costs become extremely high if posters should be produced in a smaller lot for a presentation, for a single event, or the like.

Here, therefore, as one of the suitable methods for printing in a smaller lot, an ink jet recording method has been proposed, which enables images to be recorded directly on a recording medium. In accordance with this ink jet recording method, fine ink droplets are discharged from the discharge ports provided for ink jet recording means (an ink jet recording head), and fly onto a recording medium, such as a paper sheet, thus recording images on the recording medium. With this method, it becomes unnecessary to prepare the screen form plates needed for the screen printing as described above. As a result, it is possible to curtail a great number of processes and time needed before the formation of images on the paper sheet. It also becomes possible to make the apparatus much smaller. Also, image information needed for the execution of printing can be stored on a medium, such as a tape, a flexible disc, an optical disc, hence making it possible to provide an excellent storage and reservation of the image information. In addition, there is a great advantage that image processing can be executed easily to change color arrangements, to modify layout, to prepare the enlargement or reduction of sizes, and so on with respect to the original images.

Of the ink jet recording apparatuses, the serial type recording apparatus, which records on a recording medium while executing its main scan in the direction intersecting the conveying direction of the recording medium (that is, the sheet feeding direction or the sub-scanning direction), is capable of recording in a desired area on the recording medium by repeating its operating in such a manner that the sheet feed is executed for a specific amount (the pitch feed to perform the sub-scanning) after the completion of the recording of one-line portion which has been made by recording (main scanning) an image by use of the recording means that travels along the recording medium, and that the recording (main scanning) is made for the next line portion of the image on the recording medium that has come to a stop subsequent to the last pitch feed.

On the other hand, the line type recording apparatus, which is arranged to record on a recording medium only by means of the sub-scanning in the sheet feed direction, records an image in the desired area on the recording medium by setting the recording medium in a specific recording position, and then, the sheet feed (pitch feed) is performed altogether while continuously recording one line portion after another.

In general, the ink jet type recording apparatus (ink jet recording apparatus) is arranged to record on a recording medium by discharging ink from recording means (recording head) to the recording medium, and the recording means (recording head) can be made compact easily for recording images in higher precision at higher speeds. Also, with the ink jet recording apparatus, it is possible to record on an ordinary paper sheet without any particular treatment given to it, which contributes to making its running costs lower. Also, this recording method is of non-impact type, having a lesser amount of noises in operation, among some other advantages such as an easier recording of color images by use of various kinds of ink (color ink, for instance).

Particularly, the ink jet type recording means (recording head) that discharges ink by the utilization of thermal energy is produced by arranging the electro-thermal converting means, electrodes, liquid path walls, a ceiling plate, and the like on a substrate by the application of film formation techniques using the semiconductor process, such as etching, vapor deposition, sputtering, or the like. In this manner, this recording means can be fabricated more compactly and easily with the arrangement of highly densified liquid paths (the arrangement of discharge ports). Also, by the utilization of the IC technologies and techniques, as well as the advantages of the micromachining, it is easier to elongate the recording means or to plane it (make it two dimensional) for the easier provision of fully multiple recording means, and the highly densified assembling thereof as well.

Also, in recent years, there are various demands on the kinds of recording media using different materials. Along with the developments that have been made to meet such demands, it becomes possible for a recording apparatus to use cloth, leather, unwoven stuff, or even metal, in addition to the usual recording medium, such as paper sheet (including thin paper, processed paper sheet) or thin resin plate (OHP or the like).

However, since the ink jet recording apparatus discharges ink from extremely fine discharge port formed on the discharge port surface of the recording head, it is subjected to the adhesion of foreign substances to the discharge port surface, such as solidified ink, paper particles, ink droplets, or the like. (For example, the tail portion of a main droplet becomes a fine droplet due to the surface tension of ink itself when the ink droplet is discharged for the execution of ink jet recording, and then, besides the main ink droplets required for recording, the secondary ink droplets (hereinafter referred to as satellites) or misty ink droplets (hereinafter referred to as mist) is created. The ink droplets that may adhere to the circumference of the ink discharge ports of the recording head are caused by the satellites or mist adhering to it.) The adhesion of such foreign substances may hinder the flight of ink to result in the deviation of impact positions of the ink droplet or to break the ink droplets into splash, or the satellites and mist may clog some of the ink discharge ports, thus causing the defective discharges (or even disabled discharges in some case).

Usually, therefore, an arrangement is made so that the discharge port surface is cleaned periodically or at a specific timing. As to the cleaning of the conventional ink jet recording apparatus, various structures have been disclosed in the specifications of Japanese Patent Laid-Open Application No. 06-340082, Japanese Patent Laid-Open Application No. 07-009674, Japanese Patent Laid-Open Application No. 07-052396, and some others, for example.

FIG. 1 is a view which schematically shows one structural example of a recording head. In FIG. 1, the head 2000 has a plurality of nozzles arranged in lines to form the nozzle array 2030 of one color portion. Then, the head unit 600 is formed by arranging a plurality of heads in parallel. The important portions of the side edge of the head 2000 are sealed by use of silicon sealant 2010 in order to prevent ink from leaking or entering the head from the outside.

Now, for example, if it is intended to wipe the face plane 2020 of the head unit 600 continuously with one wiper (not shown) (hereinafter referred to as a wiper blade or blade) by allowing the carriage having the head unit 600 mounted on it to move in the direction orthogonal to the nozzle arrays, the wiper is in contact with the sealant 2010 when it passes the surface thereof, which creates the stick slipping phenomenon to cause the wiper to vibrate abnormally. As a result, the ink droplets that have been scraped off by the wiper are caused to splash around eventually in some cases. The ink droplets thus splashed at that time adhere to the recording sheet, and may cause the degradation of print quality after all. The splashed ink droplets not only stain the surrounding portions, but also, the circumference of the head that has been wiped off, and adhere to the nozzles and invite the phenomenon described above that may result in the defective printing.

In order to avoid any contact between the wiper and the sealant, it may be possible to use the wiper whose width is smaller than the gap between sealants which are applied in parallel, and then, wiping is performed in the direction parallel to the nozzle arrays. In this case, the stick slipping phenomenon can be avoided, but the probability becomes much higher than the former that the dust particles and solidified ink are in contact with the nozzles. The defective prints may be created more often. Therefore, it is desirable to provide the wiping means executable in the direction orthogonal to the nozzle arrays, while avoiding any contact with the sealants.

Now, if the relative movements of the wiper and the head are too fast, there may take place a phenomenon that ink tends to pass through the wiper, making it difficult to attain the anticipated effect of wiping in some cases. It is preferable to execute wiping rather at slower relative speeds. However, in recent years, along with the development of higher speed printing, the carriage having the head unit mounted on it reciprocates at much higher speeds. If the speeds of such carriage should be made slower to obtain a good wiping effect, it may inevitably takes a longer time to complete the intended wiping operation. There is a fear, then, that the attainment of a higher printing is hindered after all.

Also, when the cleaning operation is repeatedly executed, the wiper is stained by the adhesion of ink or the like. In some cases, such ink or particles that have adhered to the wiper may be transferred to nozzles and others and adhere again to them. There is then proposed a structure whereby to arrange a cleaner to clean the wiper. However, when the blade cleaner that cleans the wiper has come to its saturation, the cleaning performance is lowered (degraded) so that the recording head is wiped with ink droplets remaining on the wiper blade. As a result, a problem is encountered that the defective recording takes place due to the defective discharges caused by the degraded wiping performance.

In order to solve this problem, (1) making the blade cleaners exchangeable, the blade cleaners are replaced before coming to the saturation; (2) with the provision of an ink absorbent whose capacity is large enough to enable the blade cleaner to serve as long as the life of the main body of the apparatus, thus preventing the saturation; and (3) ink absorbed by the blade cleaner is squeezed out to prevent the saturation, among some other preventive means.

However, the method (1) has a drawback that the user finds it extremely inconvenient to make such replacement (that is, the operativity is extremely poor); the method (2) requires a large space, making the apparatus larger unnecessarily; and the method (3) the squeezing mechanism and an additional driving source are needed to make the costs of manufacture higher significantly. Thus, there are still problems yet to be solved in this respect.

Further, as shown in FIGS. 2A and 2B, a wiper blade 10 demonstrates the most effective wiping effect (the effect of wiping off) when its leading end is in contact with the recording head 2000 that moves in the direction indicated by an arrow in FIG. 2A. This has been confirmed by experiments. On the other hand, if the belly portion of the wiper blade 10 is slidably in contact with the discharge port surface of the recording head 2000 as shown in FIG. 2B, it is impossible to obtain the wiping effect sufficiently. Also, in the state where the belly portion of the wiper blade 10 is slidably in contact with the discharge port surface as shown in FIG. 2B, the wiper blade 10 is pressed strongly to the discharge port surface 2020 of the recording head 2000. As a result, the discharge port surface 2020 becomes subjected to damages, and in order to secure the durability of the discharge port surface 2020, it is necessary to enhance the strength of that surface, creating the problem that the costs of manufacture are increased significantly. It is, therefore, very important to set appropriately the amount of approach (the amount of overlapping) of the wiper blade 10 to the recording head 2000 (the discharge port surface thereof) when determining the effectiveness of wiping performance. It is equally important to exercise a highly precise positioning when the wiper blade is arranged for the recording head.

SUMMARY OF THE INVENTION

With a view to solving the problems discussed above, the present invention is designed. It is an object of the invention to provide an ink jet printer provided with a wiping unit capable of wiping only the portions that need it, while optimally keeping the free length of the wiper; the amount of overlapping with the recording head; and the slower speeds of relative movements of the head and the wiper when wiping the ink jet recording head which is able to execute recording at high speeds.

It is another object of the invention to provide an ink jet recording apparatus and a cleaning unit by making the absorbing amount of ink smaller for a blade cleaner without making its capacity larger so as to secure the cleaning preformation for a long time with a simpler structure in order to maintain a long-term and stable wiping performance at a higher level when wiping the recording head, hence eliminating the defective recording reliably.

It is still another object of the invention to provide an ink jet recording apparatus capable of securing stably the amount of approach of wiper blades to the recording means in an appropriate value in higher precision, and also, capable of securing the amount of approach of the wiper blades constantly with respect to the switchable height of the carriage to materialize the wiping operation that can reliably remove the ink adhering to the discharge port surface of the recording head, hence eliminating the degradation of image quality due to the defective discharges.

It is another object of the invention to provide an ink jet printer which comprises a wiper member for wiping the surface of the ink jet recording head, and the ink jet recording head and the wiper member move in the same direction each other to wipe the surface of the ink jet recording head by one operation.

It is still another object of the invention to provide an ink jet printer provided with a wiper member for wiping the surface of the ink jet recording head in which the ink jet recording head and the wiper member move in the same direction each other; the moving speed of the wiper member is arranged to be faster than the moving speed of the ink jet recording head for wiping the surface of the ink jet recording head by one operation of the wiper member, and also, a cleaning mechanism is provided for cleaning the wiper member.

It is a further object of the invention to provide an ink jet printer provided with a wiper member for wiping the surface of the ink jet recording head, which comprises at least one recording head having sealant on both sides of the surface surrounding a nozzle array, and being movable in the direction at right angles to the sealant; and at least one rotational wiper member having its leading end to move in the same direction as the recording head for wiping the nozzle array without contacting with the sealant, and then, the nozzle arrays are wiped by one operation of the wiping member.

It is a still further object of the invention to provide an ink jet recording apparatus provided with a wiper blade for wiping the discharge port surface of recording means for recording by discharging ink to a recording medium, which comprises a first blade cleaner and a second blade cleaner for the wiper blade to contact therewith after wiping the discharge port surface.

It is another object of the invention to provide a cleaning unit provided with a wiper blade for wiping the discharge port surface of recording means for recording by discharging ink to a recording medium, which comprises a first blade cleaner and a second blade cleaner for the wiper blade to contact therewith after wiping the discharge port surface.

It is still another object of the invention to provide an ink jet recording apparatus for recording by discharging ink from recording means to a recording medium, and the discharge port surface of recording means thereof being wiped by the rotation of a plurality of wiper blades in the moving direction of the recording means, which comprises rotation means for rotating wiper blades; elevation means for elevating a wiper unit by swinging; a contact member being in contact with the guiding surface of a carriage; and bias means for biasing the contact member to the guiding surface, and then, the swinging center of the wiper unit is arranged to be coaxial with the axial center of one rotation shaft of the rotation means.

Other objectives and advantages besides those discussed above will be apparent to those skilled in the art from the description of a preferred embodiment of the invention which follows. In the description, reference is made to accompanying drawings, which form a part hereof, and which illustrate an example of the invention. Such example, however, is not exhaustive of the various embodiments of the invention, and therefore reference is made to the claims which follow the description for determining the scope of the invention.

BRIEF DESCRIPTION OF THE DRAWINGS

FIG. 6A is a plan view; FIG. 6B is a front view; FIG. 6C is a side view; and FIG. 6D is a cross-sectional view taken along line 6D—6D in FIG. 6A.

FIGS. 7A, 7B, 7C and 7D are views which schematically illustrate the cleaning operation of the wiper to which,the present invention is applicable.

DETAILED DESCRIPTION OF THE PREFERRED EMBODIMENTS

Hereinafter, with reference to the accompanying drawings, the detailed description will be made of the embodiments in accordance with the present invention.

Figure 3:
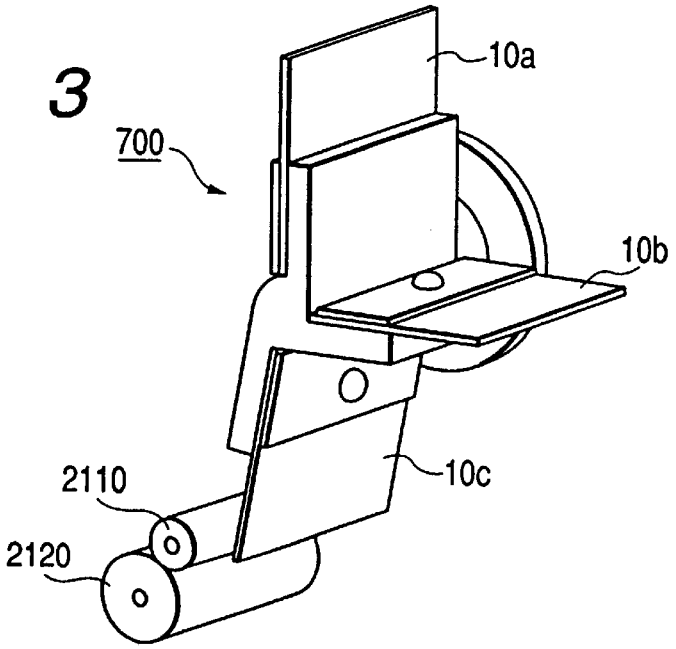
FIG. 3 is a perspective view which schematically shows one structural example of the wiper to which the present invention is applicable.

FIG. 3 is a perspective view which schematically shows the structure of the wiper blade used for the ink jet printer in accordance with the present invention. When liquid droplets are discharged for the execution of ink jet recording, each of the tail portions of the main droplets is caused to become a droplet due to the surface tension of ink itself. Then, aside from the main droplets needed for printing primarily, the secondary ink droplets (hereinafter referred to as satellites) or the misty ink droplets (hereinafter referred to as mist) are created. If the satellites or mist is caused to adhere to the circumference of the ink discharge ports of the recording head, the flight of ink is hindered, thus the impact positions being deviated or the ink droplets being broken to result in splashing. Then, if the discharge ports are clogged due to the satellites or mist, such portion tends to create the phenomenon of disabled discharges.

With such phenomenon having been created, the print quality is caused to be degraded, and the value of the product is spoiled eventually. Therefore, it is usually arranged to install wiping means for the recording head in the vicinity of capping means for the ink jet printer.

FIGS. 6A to 6D illustrate one example of the wiping means 700, which is provided with three wipers 10*a*, 10*b*, and 10*c* arranged radially around a specific shaft. Then, rotating around the specific shaft, the wipers are in contact with the ink discharge ports of the head for cleaning. Here, a reference numeral 2110 designates a first roller that cleans the wipers that have been stained with ink. Then, the structure is arranged to enable a second roller 2120 to collect the ink that has adhered to the first roller in order to keep the cleaning capability of the first roller.

By the experiments, it has been confirmed that a good wiping is possible on the following condition as one example of the ink jet wiping:

A polyurethane wiping wiper of 1 mm or less in thickness (hereinafter simply referred to as a wiper) is used for wiping with the amount of overlapping with the head being 2.0 mm or less; the free length of the wiper, 20 mm or less; and the relative speed of movement between the head and the wiper, 100 mm/sec or less.

The wiping becomes executable by allowing the head and the wiper to move relatively. For the conventional printer, there are methods, such as the one in which the head moves horizontally, while the wiper is fixed or the wiper moves, while the head is fixed. In accordance with the present invention, however, it is structured as described above that the plural wipers 10*a*, 10*b*, and 10*c* are arranged like a water wheel, which are rotated for the execution of wiping operation, and that the head moves in the same direction as the revolving direction of the wipers. The head moves at a slower speed than that of the rotating wipers. The speed, which is obtainable by subtracting the traveling speed of the head from the speed at which the leading end of each wiper rotates, is defined preferably as the relative speed at which its wiping is performed.

Now, in conjunction with FIGS. 4A to 4G, the description will be made of the wiping operation of the wiping means 700 shown in FIG. 3 for cleaning the head. Here, the wipers execute wiping beginning with the head which is in the leading position in the advancing direction of the heads.

Figure 1:
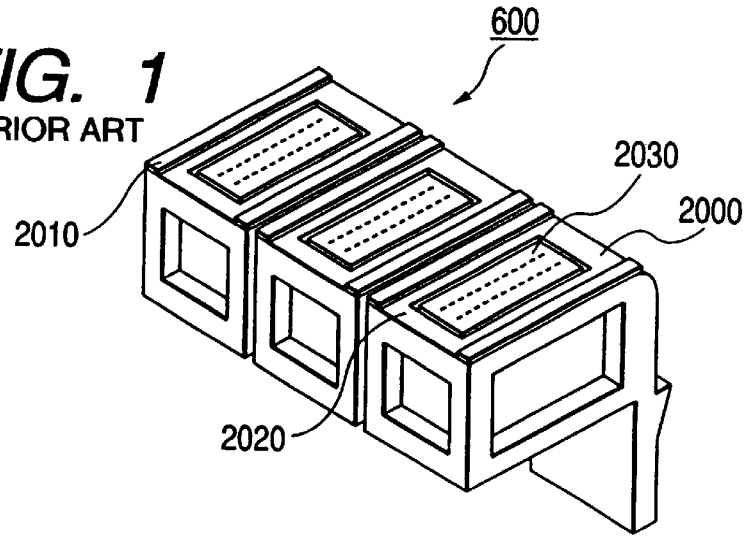
FIG. 1 PRIOR ART
FIG. 1 is a perspective view which schematically shows one structural example of a recording head.
Figure 2A:
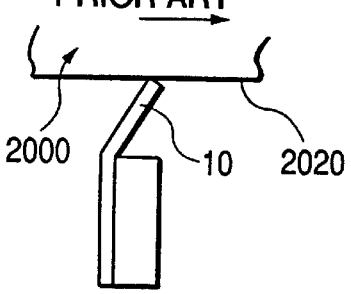
FIG. 2A PRIOR ART
FIG. 2A is a side view which schematically shows an appropriate wiping state.
Figure 2B:
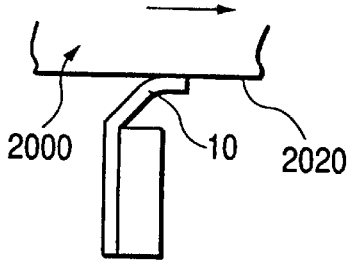
FIG. 2B PRIOR ART
FIG. 2B is a side view which schematically shows an inappropriate wiping state.
Figure 4A:
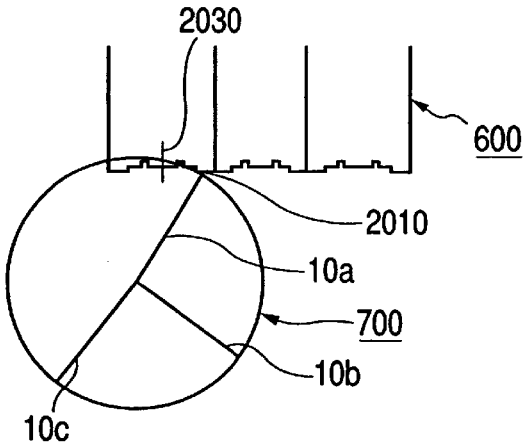
FIGS. 4A, 4B, 4C, 4D, 4E, 4F and 4G are views which schematically illustrate one example of the wiper operation with the structure to which the present invention is applicable.

FIG. 4A represents the positional relationship between the head unit 600 and the wiper unit 700 when the wiping begins. Centering on the nozzle array 2030, the first wiper 10*a* approaches from the side opposite to the head advancing direction. Then, since the first wiper 10*a* approaches the head sealant 2010 from the inner side thereof as shown in FIG. 1, there is no possibility that the first wiper 10*a* is in contact with the sealant 2010.

Figure 4B:
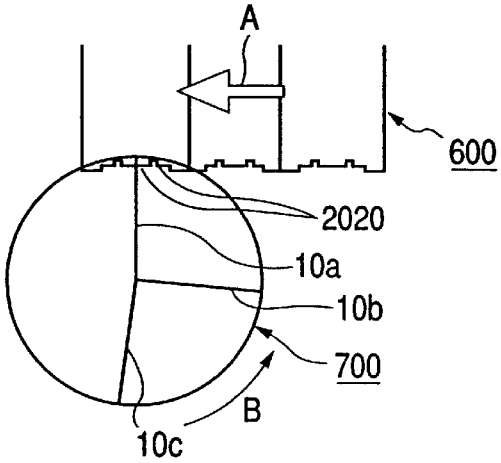

In FIG. 4B, the head unit advances in the direction indicated by an arrow A. Interlocked with the movement of the head unit 600, the wiper unit 700 also rotates in the direction indicated by an arrow B. At this juncture, assuming that the traveling speed of the head unit 600 is 6.67 mm/sec, while the rotational speed of the leading end of the first wiper 10*a* is 11.67 mm/sec, the first wiper is directed vertically after 0.6 sec. Then, this wiper arrives at the center of the nozzle array 2030, and the amount of overlapping of the first wiper 10*a* with the head unit 600 is in agreement with the preferable condition described earlier. Further, the numeral value, which is arrived at by subtracting the traveling speed of the head unit 600 from the rotational speed of the leading end of the first wiper 10*a*, is also in agreement with the preferable condition described earlier.

The wiping is executed in such a manner that the ink droplets residing between the first wiper 10*a* and the head surface 2020 are drawn by the first wiper 10*a*. Here, since a water film is coated on the head surface, the wettability is extremely inferior. In contrast, the first wiper 10*a* has a higher wettability than the water film on the surface of the head. Therefore, when the first wiper passes on the water film, ink easily adheres to the first wiper 10*a*.

Figure 4C:
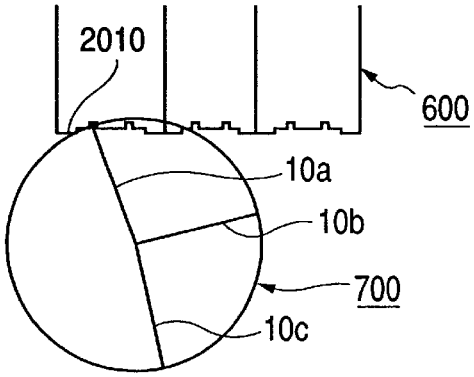

In FIG. 4C, the relative movements of the head unit 600 and the first wiper 10*a* further advance. Then, after 1 sec since the wiping has begun, the wiping by the first wiper 10*a* is completed. Thus, the first wiper 10*a* has passed through the nozzle array 2030. At this juncture, the first wiper 10*a* passes it through from the inner side of the head sealant 2010, and there is no possibility that the first wiper 10*a* is in contact with the sealant 2010. In this respect, when the first wiper parts from the facing plane, ink lines may be left, but such portion where the ink lines may be left is far away from the nozzles, it is safe to mention that the wiping has been executed sufficiently.

Figure 4D:
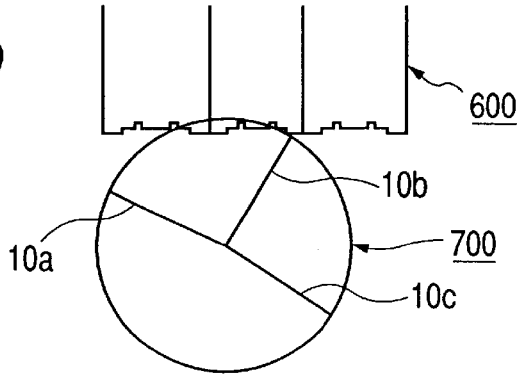

In FIG. 4D, after 1.9 sec since the wiping has begun, the relative movement of the second wiper 10*b* advances to the position where it begins wiping the central head. Here, the wipe starting position is in the inner side of the sealant 2010 as in the case shown in FIG. 7A.

Figure 4E:
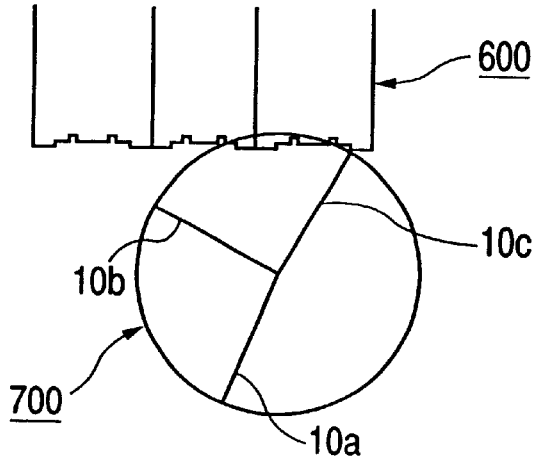

In FIG. 4E, after 3.8 sec, the wiping of the central head is completed, and then, the third wiper 10*c* is in the position where it begins wiping the third head. In this case, too, the wipe starting position is in the inner side of the sealant 2010 as in the case of the FIG. 7A and FIG. 7B.

Figure 4F:
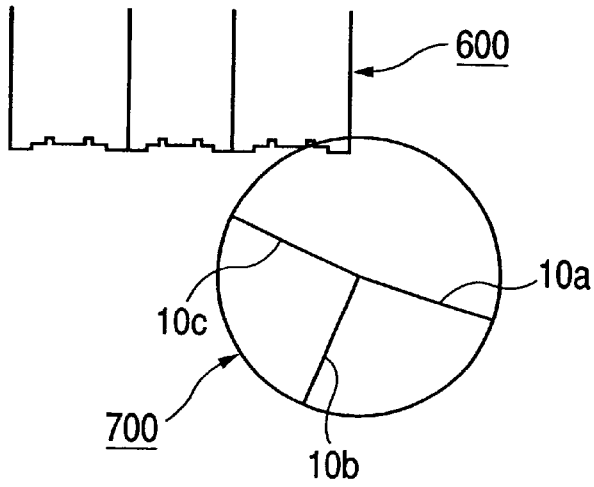

In FIG. 4F, after 5.7 sec. the wiping of all three heads is completed.

Figure 4G:
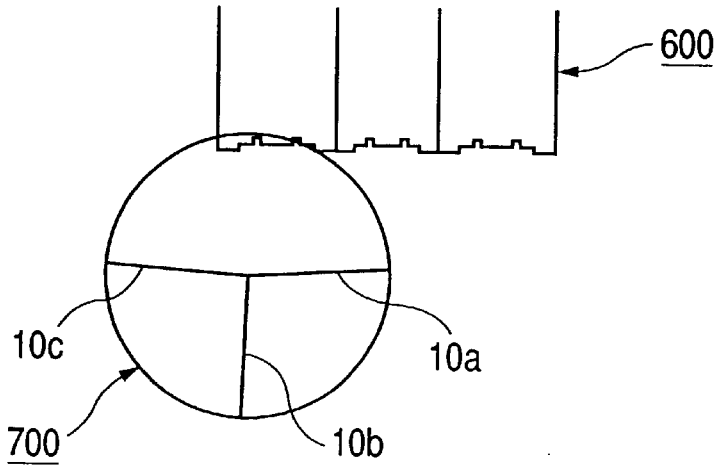

In FIG. 4G, the wipers are retracted to prevent them from intervening in the head operation for its normal printing.

In accordance with the present invention, it becomes possible to perform excellent wiping without allowing the wipers to pass through the head sealant, while maintaining the preferable condition of the wiping operation.

Now, with reference to FIGS. 5A to 5D, the description will be made of the wiper cleaners in accordance with the present invention.

Figure 5A:
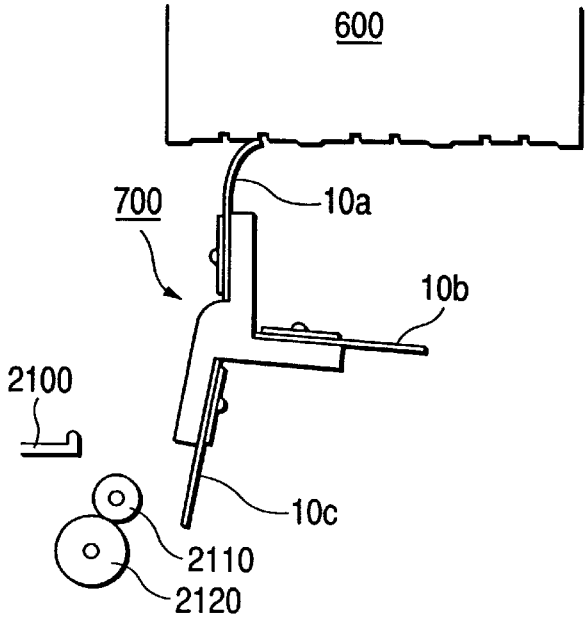
FIGS. 5A, 5B, 5C and 5D are views which schematically illustrate another example of the wiper operation with the structure to which the present invention is applicable.

In FIG. 5A, the first wiper 10*a* executes the wiping of the nozzle array.

Figure 5B:
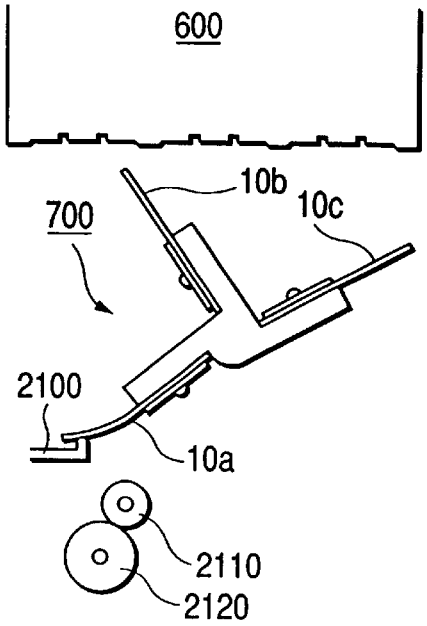

In FIG. 5B, at the time of the second wiper 10*b* having completed its wiping, the first wiper 10*a* is in contact with the scraper tongue 2100 to scrape down large ink droplets and dust particles from the first wiper 10*a*.

Figure 5C:
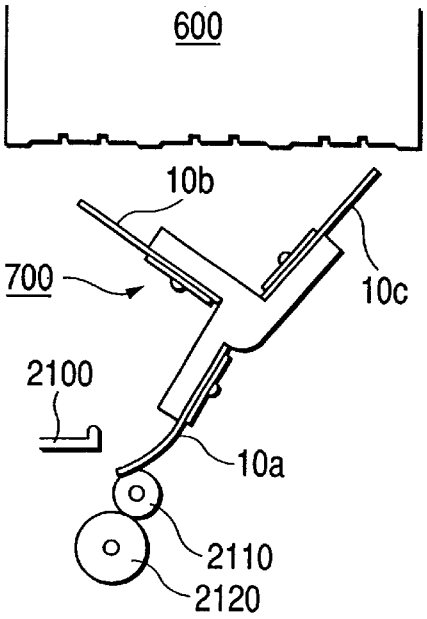

In FIG. 5C, after having passed the scraper tongue 2100, the first wiper 10*a* abuts upon the absorption roller 2110 so that fine ink droplets still adhering to the surface of the wiper are absorbed.

Figure 5D:
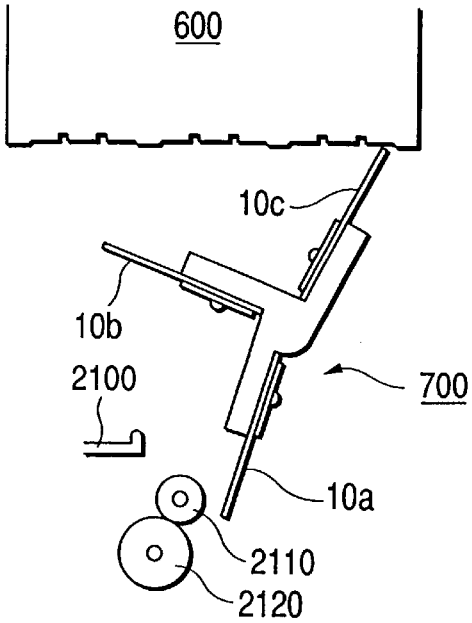

In FIG. 5D, when the first wiper 10*a* has passed through the absorption roller 2110, the third wiper 10*c* abuts upon the head unit 600. The absorption roller 2110, then, continues its rotation in order to transfer ink to the contact roller 2120.

If a wiper wipes off the head, while another wiper is in contact with the scraper tongue 2100 or the absorption roller 2110, vibration or variation of wiping speed may be caused when the wiper passes through the scraper tongue 2100 or the absorption roller 2110. If such vibration or variation of the wiping speed occurs, sufficient wiping can hardly be anticipated. Therefore, the scraper tongue 2100 and the absorption roller 2110 are arranged in locations where the head wiping is not affected by the presence of these devices.

The ink droplets that have adhered to the scraper tongue 2100 fall off by its own gravity, and a waste ink bottle (not shown) collects them. For the absorption roller 2110, polypropylene foaming material or some other foaming material is used. For the contact roller 2120, a foaming material of the same kind is also used as the absorption roller 2110. Further, it is preferable to enhance the absorptivity of this roller by the application of an interfacial active agent or some other treatment. In this case, no treatment of active agent is given to the absorption roller 2110, but it should be arranged to enable it to catch ink droplets only by the surface of the roller, while the active agent treatment is given to the contact roller 2120 so as to allow it to absorb ink into its interior. In this manner, the surface condition of the rollers are maintained stably at all the time. The amount of ink absorbed by the contact roller is a very small quantity, and the natural drying is good enough to keep its absorptive capability well.

Figure 6A:
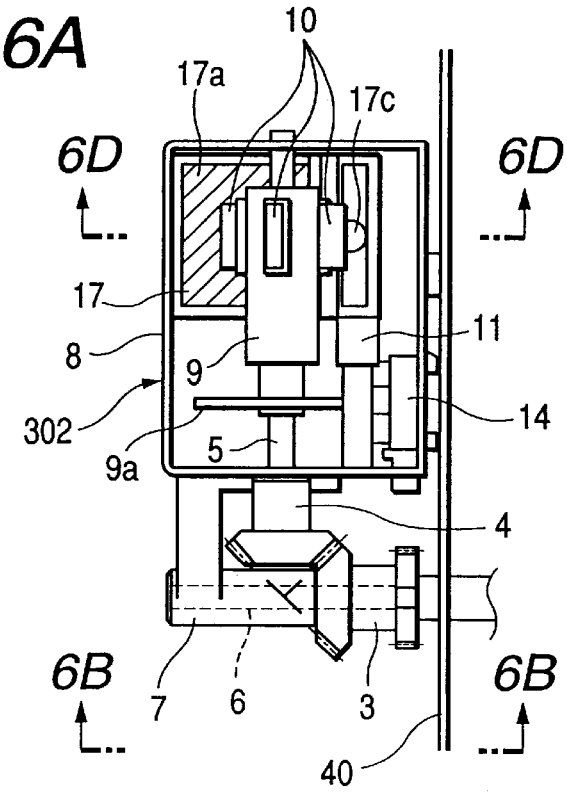
FIGS. 6A, 6B, 6C and 6D are views which schematically illustrate the structural example including the circumference of the wiper to which the present invention is applicable.
Figure 6B:
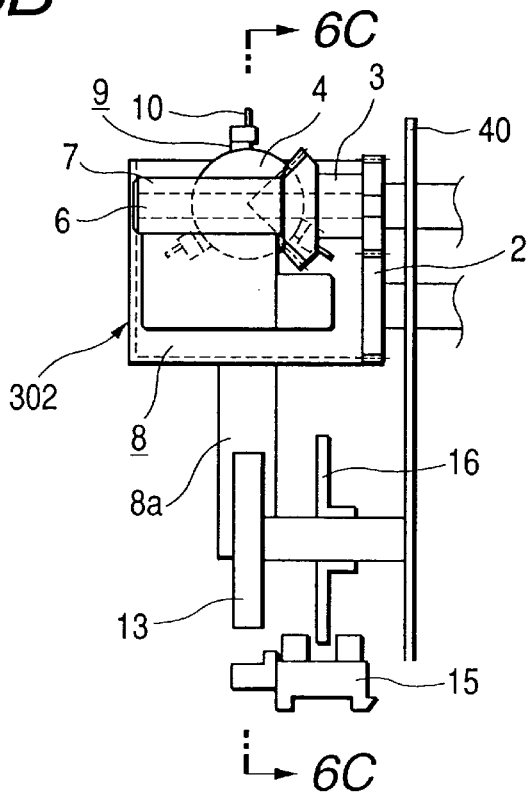
Figure 6C:
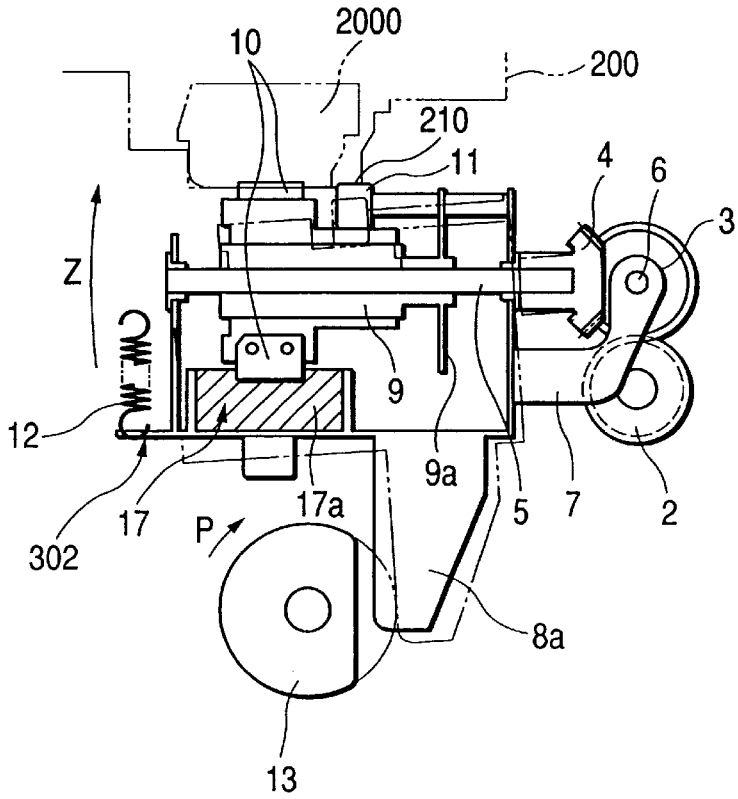
Figure 6D:
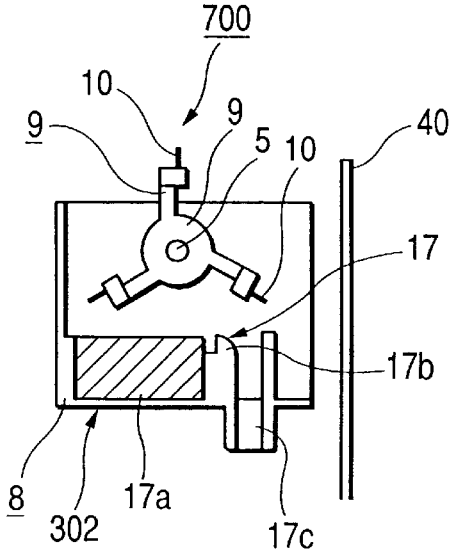

FIGS. 6A to 6D represent another wiper unit (cleaning unit). These are a plan view, a front view, a vertically sectional view (taken along 6C—6C), and a cross-sectional view (taken along 6D—6D), respectively. FIG. 6B is the front view observed from line 6B—6B in FIG. 6A. FIG. 6C is a cross-sectional view taken along line 6C—6C in FIG. 6B. FIG. 6D is a vertically sectional view taken along line 6D—6D in FIG. 6A.

In FIGS. 6A to 6D, a reference numeral 2 designates the wiper gear A which is rotatively driven by a stepping motor. The rotation of the stepping motor is transmitted to the wiper gear A through a gear train and a driving switch over clutch (not shown). Here, for the driving switch over clutch, there is used, for example, the one which is provided with a gear unit, an electromagnetic coil unit, and a rotation shaft, and which is structured so that the rotation of the gear unit is transmitted to the rotation shaft when the electromagnetic coil unit is energized, and that only the gear unit runs idle when the electromagnetic coil unit is turned off.

The wiper gear 2 is arranged to engage with the wiper gear 3 which is a bevel gear. Then, the wiper gear 3 is axially supported rotatively by the swing shaft 6 fixed to the side plate 40 of the supply and recovery unit. The bevel gear portion-of the wiper gear 3 engages with the wiper gear 4 which is also a bevel gear. The wiper gears 3 and 4 provided with the bevel gears, respectively. Then, the rotation thereof is directed almost at right angles. On the central portion of the wiper gear 4, the wiper rotation shaft 5 is arranged. The swing shaft 6 is fixed to the aforesaid side plate 40. The swing shaft 6 rotatively supports the wiper gear 3 rotatively, and also, axially supports the wiper bearing 7 rotatively at the same time. The wiper bearing is fixed to a wiper case 8 which is almost a box type. Therefore, the wiper case 8 is supported by the wiper bearing 7 swingably with the swing shaft 6 as its center.

To the wiper case 8, the wiper rotation shaft 5 is axially supported. Also, for the wiper case 8, there is provided a cam contact 8*a*, and the elevation cam 13, which is formed by a rotational member, is arranged to abut upon this cam contact. To the wiper rotation shaft 5, a blade holder 9 is fixed. The wiper blade 10 is fixed to this blade holder 9. Also, for the blade holder 9, a sensor flag unit 9*a* is provided. The sensor flag unit 9*a* detects the rotational phases of the blade holder in cooperation with the wiper rotation sensor 14.

The wiper blade 10 is formed by rubber or some other elastic material in the form of a thin plate as the conventional example. The wiper blade is arranged to wipe the discharge port surface 2020 of the recording head 2000 in the arrangement direction of the recording head (the direction at the right angles to the recording sheet carrying direction indicated by an arrow B in FIG. 19, that is, the traveling direction of the carriage 200). In accordance with the present embodiment, the three wiper blades 10 are installed at equal intervals on the circumferential direction of the blade holder 9. Here, a reference numeral 11 designates a roller. This contact roller 11 is axially and rotatively supported by a shaft fixed to the wiper case 8. A reference numeral 12 designates a bias spring. One end of the bias spring 12 is connected with the wiper case 8, while the other end thereof is connected with a cut off portion (not shown), to form it as a tensioning spring whereby to bias the wiper case 8 in the direction indicated by an arrow Z in FIG. 6C with the swing shaft 6 as its center. Here, a reference numeral 13 designates an elevation cam. This elevation cam 13 is arranged to be driven rotatively in the direction indicated by an arrow P in FIG. 6C by the rotation power transmitted from the stepping motor 1 through the gear train and drive switch over clutch (not shown). Here, in this case, the drive switch over clutch is exactly the same as the drive switch over clutch used for the rotation driving of the wiper blade 10 described earlier.

In FIGS. 6A to 6D, a reference numeral 14 designates a wiper rotation sensor. This wiper rotation sensor 14 detects the rotational phases of the wiper blade 10 by the detection of the sensor flag unit 9*a* described earlier. As the wiper rotation sensor 14, an optical sensing means (formed by LED and phototransistors) is used, for example. Here, it may be possible to adopt the structure whereby to enable the phototransistors to detect the light from the LED and transmit signals corresponding to the rotation of the sensor flag. Then, the rotational phase of the wiper blade 10 is detected by the detection signals from the phototransistor. A reference numeral 15 designates a wiper elevation sensor. This wiper elevation sensor 15 detects the phases of the elevation cam 13 by detecting the status of the wiper elevation flag 16. The wiper elevation flag 16 is fixed to the drive transmission shaft of the elevation cam 13, and this flag rotates together with the elevation cam 13. As the wiper elevation sensor 15, an optical detection means is adoptable in the same manner as the wiper rotation sensor 14.

Now, the description will be made of the operation of the wiper unit (cleaning unit) 302 structured as above to wipe (clean off) the discharge port surface 2020 of the recording head 2000.

Usually, the elevation cam 13 is standstill at the position indicated by broken line in FIG. 6C. In this state, the wiper elevation sensor 15 detects the current status of the wiper elevation flag 16. Also, in this state, the wiper unit 302 is pressed down by the swing shaft 6 which has rotated counterclockwise centering on the swing shaft 6 against the biasing force exerted by the bias spring 12. Thus, the wiper blade 10 is not allowed to be in contact with the recording head 2000 at all. Now, at an appropriate timing during recording or after the execution of a suction recovery process, the carriage 200 moves to the home position (the capping position on the right side in FIG. 19) in accordance with the wiping process command issued by the CPU. Then, the CPU causes the wiper elevation drive switch over clutch to be turned on to drive the stepping motor 1. The elevation cam 13 rotates to the phase shown in FIG. 6C. In this case, the amount of rotation is set in advance at the one in which the elevation cam is driven by given steps after the wiper elevation sensor 15 has detected the on or off of the wiper elevation flag 16. Then, when contact between the elevation cam 13 and the contact unit 8*a* is released, the wiper case 8 rotates clockwise centering on the swing shaft 6 by means of the biasing force exerted by the biasing spring 12 as shown in FIG. 6C. Hence, the wiper case 8 is in contact with a stopper (not shown) provided for the side plate 40 of the supply and recovery unit. In this state, the carriage 20 is still in the capping position (home position), and the contact roller 11 axially supported by the wiper case 8 is extruded upward from the guide surface 210 (the surface of the traveling path) of the carriage 200.

Then, when the carriage 200 moves in the left direction from the home position on the right side and arrives at above the wiper unit 302, the contact roller 11 is guided to be in contact with the guiding surface 210 of the carriage 200 so that the wiper unit 302 is pressed downward, thus allowing the swing shaft 6 to rotate counterclockwise. When the contact roller 11 is in a state where it is in contact with the guiding surface 210 of the carriage 200, the gap (difference in height) is made always constant between the upper face of the contact roller 11 and the leading end (upper end) of the wiper blade 10. Therefore, the amount of approach of the wiper blade 10 to the discharge port surface 2020 of the recording head 2000 is always at an appropriate value which is set specifically. In other words, by setting the aforesaid gap between the upper ends at a specific value in advance, the amount of approach of the wiper blade 10 to the discharge port surface 2020 can be set at an appropriate value at all the time, thus making it possible to secure the wiping capability stably and reliably. In this respect, the structure needed for setting the amount of approach of the wiper blade will be described later.

Then, the CPU causes the drive switch over clutch (not shown) for use of wiper rotation to be turned on to rotate the stepping motor 1, which serves as the driving source of the supply and recovery unit, in synchronism with the movement of the carriage 200. The wiper blade 10 is then in contact with the discharge port surface 2020 of the recording head 2000 to wipe off the circumferential edges of the discharge ports one after another. Also, three wiper blades 10 are arranged at equal intervals on the circumferential direction of the blade holder 9 so as to wipe off and clean (to perform wiping for) three recording heads 2000 while the wiper blades complete one cycle (per rotation). If six recording heads 2000 are mounted on the carriage 200 as for the present embodiment, it is possible to wipe off all the recording heads 2000 by the two cycles (two rotations) of the wiper holder 9.

Now, the description will be made of the structure and operation of the cleaning means of the wiper blade 10 of the wiper unit (cleaning unit) 302.

In FIG. 6D, a first blade cleaner 17*b* and a second blade cleaner 17*a* are arranged for the wiper case 8, with which the wiper blades 10 are in contact while rotating one round. Each of the wiper blades 10 that has wiped off the recording heads 2000 abuts upon the first cleaner 17*b* at first, and then, abut upon the second cleaner 17*a*. Here, the first blade cleaner 17*b* scrapes off ink adhering to each of the wiper blades 10 largely. This cleaner is formed by material, such as resin, having a lower ink absorptivity. On the other hand, the second blade cleaner 17*a* absorbs remaining ink on each of the wiper blades after it has been in contact with the first blade cleaner, thus being formed by material having a higher ink absorptivity. The first blade cleaner 17*b* has an inclined surface which is connected with the inner surface of the exhaust outlet 17*c* formed on the lower side of the first cleaner. These first blade cleaner 17*b*, second blade cleaner 17*a*, and exhaust outlet 17*c* are housed in the wiper case 8 to constitute blade cleaning means 17.

Now, hereunder, the description will be made of the operation of the blade cleaning means 17. FIGS. 7A to 7D are cross-sectional views which correspond to FIG. 6D and schematically illustrate the sequential operation of the wiper blades 10 of the blade cleaning means 17. By the rotation of the wiper rotation shaft 5, each of the wiper blades 10 is in contact with the discharge ports of each of the recording heads 2000 one after another for wiping. As shown in the enlarged view in the leader circle of FIG. 7A, ink droplet W adheres to the wiper blade 10 immediately after having wiped off the discharge port surface 2020. Then, when the next wiper blade 10 rotates in the direction indicated by an arrow C for wiping, the wiper blade 10, which is ahead thereof immediately after wiping, abuts upon (to be in contact with) the first blade cleaner 17*b* so that the ink droplet W is scraped off. However, since the first blade cleaner 17*b* has a lower ink absorptivity (or it is incapable of absorbing ink), there are still fine ink droplets w remaining on the wiper blade 10 as shown in the enlarged view in the leader circle of FIG. 7C.

When the wiper blade 10 further rotates, the aforesaid blade that has passed the first blade cleaner 17*b* abuts upon the second blade cleaner 17*a* as shown in FIG. 7D. Then, the fine ink droplets w on the wiper blade 10 are transferred to the second blade cleaner 17*a* which absorbs them. Since the second blade cleaner 17*a* is formed by the material which has a good ink absorptivity, the fine ink droplets w on the wiper blade 10 are also removed (cleaned) reliably. With the operation of the blade cleaners described above, the first blade cleaner 17*b* removes most of the ink droplets. Therefore, as compared with the conventional system, the amount of ink absorbed by the second cleaner 17*a* is substantially smaller, hence making it possible to make the volume (capacity) of the second blade cleaner 17*a* smaller accordingly. Then, with the provision of a desired room for the volume of the second blade cleaner 17*a*, it becomes unnecessary to arrange any means for making its replacement possible or to arrange any mechanism for squeezing ink for a longer use. Also, the first blade cleaner 17*b* is incapable of absorbing ink (or its ink absorption is low), and also, the inclined surface is formed as shown in FIGS. 7A to 7D. As a result, the ink droplets scraped off from each of the wiper blades 10 is guided to the exhaust outlet 17*c* which is formed with the continued face with the inclined surface, and collected by means of the self gravity of ink droplets thus scraped off into the waste ink tank (not shown) arranged to be connected with such continued face.

In accordance with the present embodiment, the first blade cleaner 17*b* and the second blade cleaner 17*a* are arranged as described, and then, the wiper blades 10 of the rotary wiper mechanism 302, which wipe off the discharge port surface 2020 of the recording head 2000, are arranged to be in contact with the blade cleaners one after another while the wiper blades complete its one round. The first blade cleaner 17*b* is formed by the material having a lower ink absorptivity so as to scrape off ink droplets W adhering to each of the wiper blades 10 largely. The second blade cleaner 17*a* is formed by the material having a higher ink absorptivity to absorb ink droplets remaining on each of the wiper blades 10 after having passed the first blade cleaner 17*b*. With the structure thus arranged, the amount of ink to be absorbed by the second blade cleaner 17*a* can be made smaller. In this way, the volume of this blade cleaner is not necessarily made larger, while, with a simple structure, it becomes possible to secure the cleaning capability for a long time for the maintenance of the long-term and stable wiper performance at a higher level when the discharge port surface 2020 of the recording head 2000 is wiped off, hence making it possible to eliminate defective recording reliably.

Figures 1, 8:
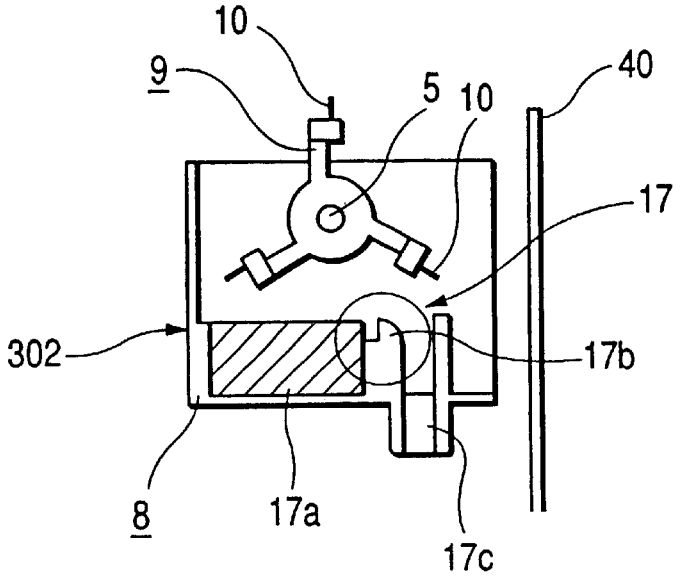
FIG. 8 is a view which schematically shows another structural example of the cleaning member of the wiper to which the present invention is applicable.

FIG. 8 is a cross-sectional view which shows schematically another embodiment of the blade cleaning means 17 described above in accordance with the present invention.

In accordance with the present embodiment, the configuration of the first blade cleaner 17*b* of the cleaning means 17 differs from the one represented in FIGS. 6A to 6D and FIGS. 7A to 7D. All the other structures thereof are substantially the same as those of the previous embodiment. Here, therefore, the description will be made only of the blade cleaner 17*b* portion.

In FIG. 8, as shown in an enlarged view in the leader circle, the first blade cleaner 17*b* is formed by the inclined stepping surface 17*d*. With the structure thus arranged, each of the wiper blades 10 is in contact with the edge portion in each step of its operation so that the ink droplet scraping effect is further improved. The ink droplets thus scraped off to adhere to the first blade cleaner 17*b* are guided into the exhaust outlet 17*c* by its own gravity. Also, with the rough finish of the surface of the first blade cleaner 17*b* which contacts with each of the wiper blades 10 or with the provision of meshed holes thereon, the scraping effect is improved still more.

Therefore, in accordance with the embodiment represented in FIG. 8, it becomes possible to enhance the cleaning effect (ink droplet scraping effect) further in addition to the same effect obtainable by the previous embodiment. Here, for the materials of the first blade cleaner 17*b* and the second blade cleaner 17*a* of each of the above embodiments, resin and ink absorbent can be selected as described above. However, the present invention is not necessarily limited to such selection. It may be possible to select any other appropriate materials freely if only the materials present a combination of the one which is incapable of absorbing ink (or having a lower ink absorptivity) with the other which has an excellent ink absorptivity.

In this respect, the above embodiments have been described by exemplifying the serial type ink jet recording apparatus that records on a recording medium (recording paper sheet or the like) by allowing recording means to move relatively with respect to such recording medium, but the present invention is also applicable to the ink jet recording apparatus which is structured to clean the discharge ports by use of the wiper blades by serially utilizing the scanning of recording means. In this case, the first blade cleaner and the second blade cleaner may be structured attachably to the arrangement of recording means or to the arrangement of the carriage to be mounted on the recording means.

Figure 9:
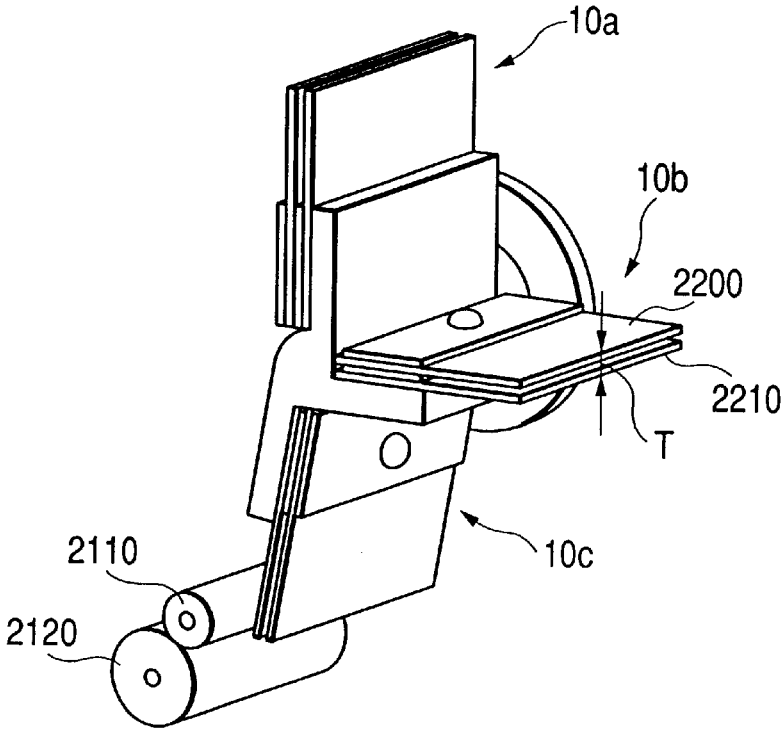
FIG. 9 is a perspective view which schematically shows another structural example of the wiper to which the present invention is applicable.

FIG. 9 is a perspective view which illustrates another structural example of wipers. Here, by use of the bubble jet printer described above, each of the wipers 10*a*, 10*b*, and 10*c* of a wiping mechanism is doubled, that is, the front wiper 2200 is installed together with the rear wiper 2210 with a gap T, respectively.

Even if the contact between the front wiper 2200 and the recording head is hindered due to paper particles, solidified ink, or the like in wiping off the head so that ink droplets may remain unwiped, the rear wiper 2210 performs wiping to follow. In this manner, it is possible to execute wiping stably.

The entire timing of wiping, and the cleaning method adopted by each of the front wipers are the same as those of the wiping example described earlier. By the rotary motion of the wiper unit, wiping is performed. The head moves in the same direction of the wiper advancement. The speed of the head movement is slower than that of each wiper. The preferably relative speed is obtained by subtracting the speed of the head movement from the wiper speed at its leading end. The wiping is also executed, while avoiding the contact between each of the wipers and the sealant applied to each of the heads.

Figure 10:
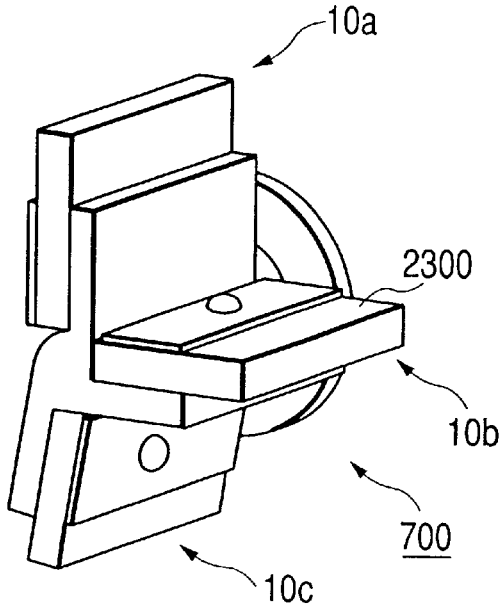
FIG. 10 is a perspective view which schematically shows still another structural example of the wiper to which the present invention is applicable.

FIG. 10 is a perspective view which illustrates still another structure of the wipers. Here, by use of the bubble jet printer described above, each of the wipers 2300 is formed by PP (polypropylene) foaming material. The porosity of the foaming material is 50% or more or more preferably, it is approximately 80%.

Since the foaming material is in contact with the head, it is not desirable to given any activation process to the foaming material. However, the foaming material without any activation treatment has a lower ink absorptivity. Therefore, it is preferable to use it after being moisturized. The moisture content is 60% or less or more preferably, it is approximately 45%.

In wiping, the head and each wiper is overlapped. The foaming material is depressed by a certain pressure. Therefore, if the moisture content of the foaming material is high, the pure water is squeezed out from the foaming material eventually when the foaming material is in contact with the head. If this pure water may enter the interior of the head, it causes the disabled discharges or twisted discharges. Under the circumstances, the moisture content of the foaming material should be controlled.

Figure 11A:
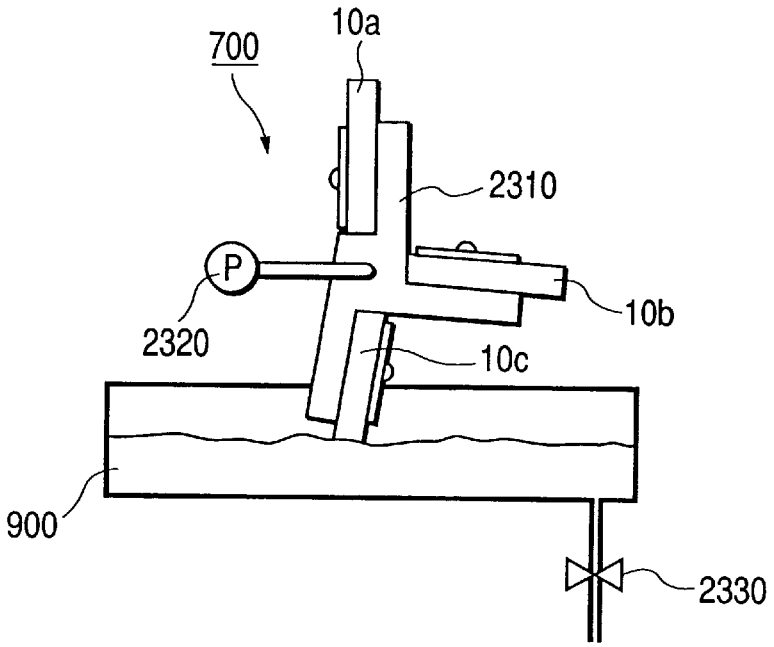
FIGS. 11A and 11B are views which schematically illustrate another structural example of cleaning by use of the wiper to which the present invention is applicable.
Figure 11B:
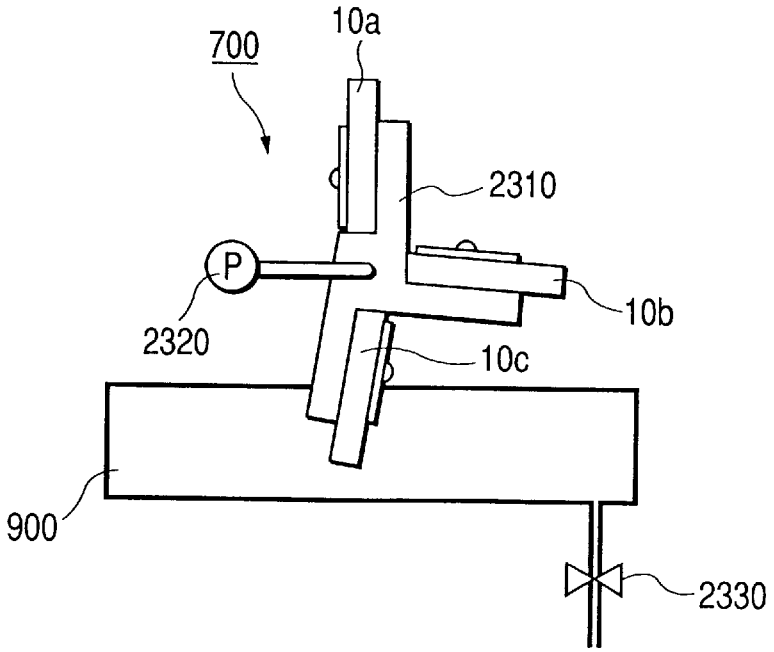

With reference to FIGS. 11A and 11B, the method of the moisture control will be described.

Before wiping, the wiper unit 700 is driven to rotate one round while the head is in the retracted position. Below the wiper unit 700, there is arranged a wiper cleaning unit 900. Here, by use of an induction pipe (not shown), pure water is induced to the wiper cleaning unit 900 as shown in FIG. 11A. Along with the rotation of the wiper unit 700, each of the wipers is immersed into the pure water one after another so that it is cleaned and moisturized. When the wiper unit 700 completes one round, the pump 2320 connected with the wiper holder 2310 performs its suction for a given period in order to control the moisture content.

As shown in FIG. 11B, the structure is arranged so that any one of the wipers is not in contact with the pure water during the wiping operation by releasing the valve 2330 to exhaust the pure water in the wiper cleaning unit 900 when wiping is executed. In this manner, the wiping is performed by use of the moisturized foaming material, hence making it possible to execute the stabilized wiping at all the time. The method of wiping is the same as that of the previous embodiments. By the rotary motion of the wiper unit 700, wiping is performed. The head moves in the same direction of the wiper advancement. The speed of the head movement is slower than that of the wiper movement. The preferably relative speed is obtained by subtracting the speed of the head movement from the wiper speed of its leading end. The wiping is also executed, while avoiding the contact between each of the wipers and the sealant applied to each of the heads.

Figure 12:
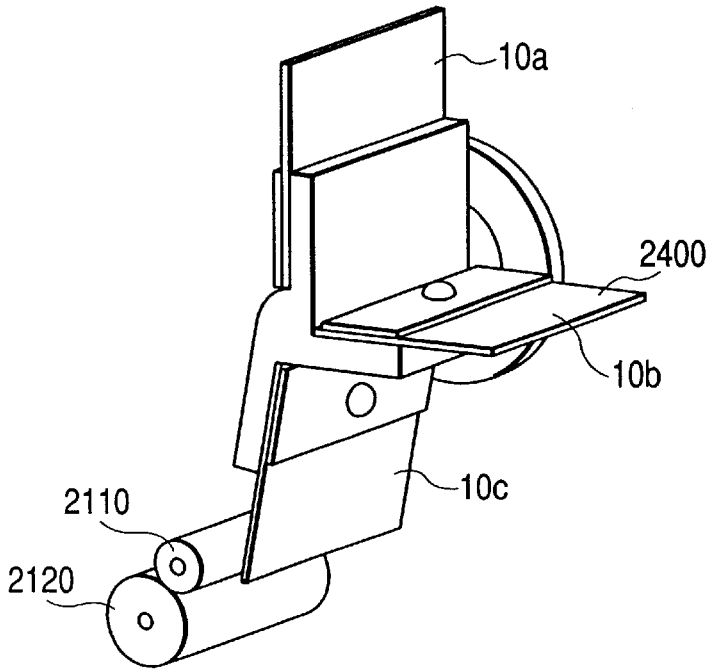
FIG. 12 is a perspective view which schematically shows still another structural example of the wiper to which the present invention is applicable.

FIG. 12 is a perspective view which illustrates still another structure of wipers. Each of the wipers is formed by polyethylene terephthalate (hereinafter referred to as PET) as its main material in a thickness of 0.5 mm or less. The PET has a higher rigidity than polyurethane, which makes it easier to form it at right angles. Also, it is confirmed that with the higher rigidity, the PET wipers produce a higher effect on scraping off the ink droplets which have been solidified on the surface of the head. The method of cleaning and the method of wiping are the same as those of the first embodiment. By the rotary motion of the wiper unit 700, wiping is performed. The head moves in the same direction of the wiper advancement. The speed of the head movement is slower than that of the wiper movement. The preferably relative speed is obtained by subtracting the speed of the head movement from the wiper speed at its leading end. The wiping is also executed, while avoiding the contact between each of the wipers and the sealant applied to each of the heads.

Figure 13A:
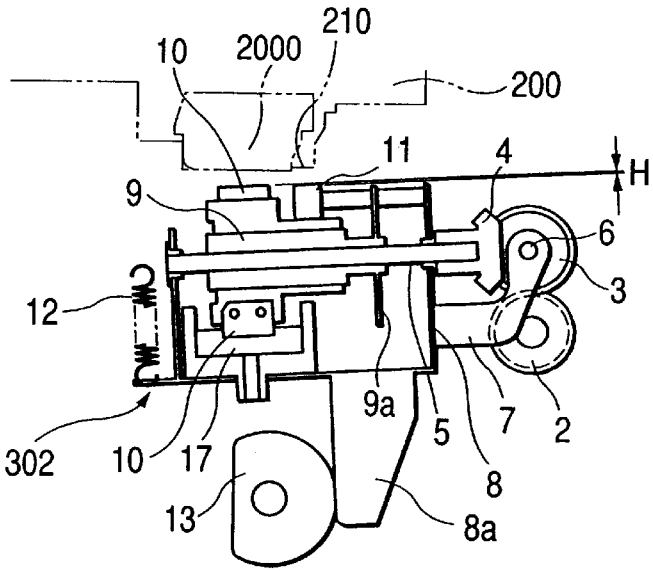
FIGS. 13A, 13B and 13C are side views which illustrate schematically the approach amount adjustment mechanism arranged for the wiper, and the respective states of the adjustment operation thereof.
Figure 13B:
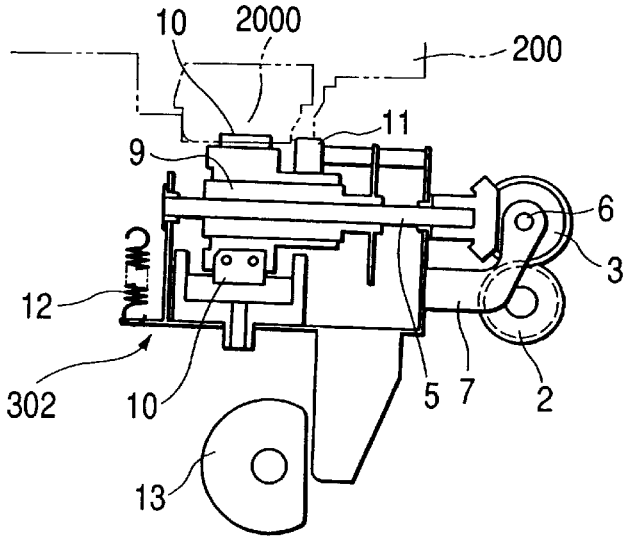
Figure 13C:
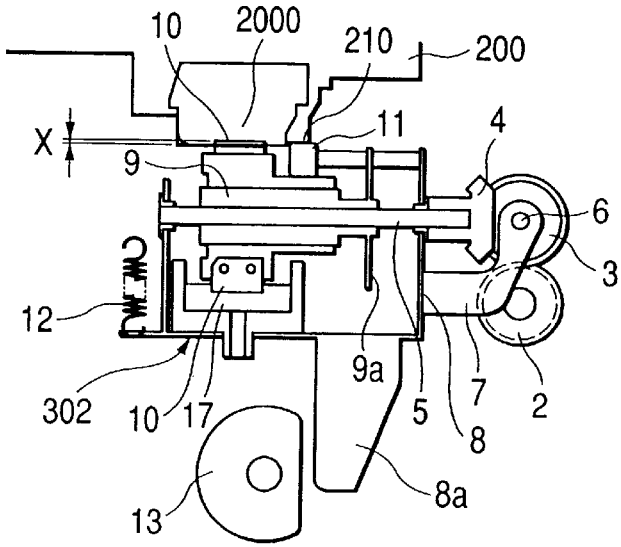

Now, in consideration of the structure needed for adjusting the approach amount, the description will be made of the wiping operation of the wiper unit 302 represented in FIGS. 6A to 6D. FIGS. 13A to 13C are cross-sectional views which schematically illustrate the wiping operation on the same vertical section as shown in FIG. 6C. In FIGS. 13A to 13C, the elevation cam 13 is usually standstill in a posture as in FIG. 13A. In this state, the wiper elevation sensor 15 shown in FIG. 6B detects the wiper elevation flag 16. Also, in this state, the wiper unit 302 is pressed downward by being rotated counterclockwise by the elevation cam 13, centering on the swing shaft 6 against the biasing force exerted by the bias spring. Therefore, there is no possibility that the wiper blades 10 are in contact with the recording head 201. Now, therefore, at an appropriate timing during the recording operation or after the suction recovery process, the CPU issues the command of the wiping process. Then, the carriage 200 moves to the home position. The CPU causes the drive switch over clutch for use of the wiper elevation to be turned on to drive the stepping motor 1. The elevation cam 13 is then rotated to the phase represented in FIG. 13B. The rotational amount at that time is predetermined to be a rotational amount for which specific steps are driven since the wiper elevation sensor 15 has detected the ON or OFF signal of the wiper elevation flag 16. In this way, the contact between the elevation cam 13 and the cam contact portion 8*a* is released. Then, by the biasing force of the bias spring 12, the wiper case 8 is raised by being rotated clockwise centering on the swing shaft 6 as shown in FIG. 13B. The wiper case 8 abuts upon a stopper (not shown) fixed to the side plate 40 of the supply and recovery unit to be in the state as shown in FIG. 13B. In this state, the carriage 200 is still in the home position (capping position), and the contact roller 11 axially supported by the wiper case 8 is extruded upward from the guide surface 210 (the surface of the traveling path) of the carriage 200.

Then, when the carriage 200 moves in the left direction from the home position on the right side and arrives at above the wiper unit 302, the contact roller 11 is guided to be in contact with the guiding surface 210 of the carriage 200 so that the wiper unit 302 is pressed downward, thus allowing the swing shaft 6 to rotate counterclockwise to present the current status as shown in FIG. 13C.

Here, as shown in FIG. 13C, when the contact roller 11 is in a state where it is in contact with the guiding surface 210 of the carriage 200, the gap (difference in height) between the upper face of the contact roller 11 and the leading end (upper end) of the wiper blade 10 is made always constant. Therefore, the amount of approach of the wiper blade 10 to the discharge port surface 2020 of the recording head 2000 is always at an appropriate value X which is set specifically. In other words, by setting the aforesaid gap H between the upper ends at a specific value in advance, the amount of approach of the wiper blade 10 to the discharge port surface 2020 can be set at an appropriate value X at all the time. The components related to the amount of approach X of the blades are the guiding surface 210 of the carriage 200→the contact roller 11→the wiper case 8→the blade holder 9→the wiper blades 10. In this way the numbers of parts that may inclusively intervene can be reduced significantly. As a result, the amount of approach X of the blades can be secured stably in high precision.

Then, the CPU causes the drive switch over clutch (not shown) for use of the wiper rotation to be turned on to rotate the stepping motor 1, which serves as the driving source of the supply and recovery unit, in synchronism of the movement of the carriage 200. Each of the wiper blades 10 is then in contact with the discharge port surface 2020 of the recording head 2000 to wipe off the circumferential edges of the discharge ports one after another. FIG. 13C shows the state when this wiping is performed. Also, three wiper blades 10 are arranged at equal intervals on the circumferential direction of the blade holder 9 so as to wipe off and clean (to perform wiping for) three recording heads 2000 while the wiper blades complete one cycle (per rotation). If six recording heads 2000 are mounted on the carriage 200 as for the present embodiment, it is possible to wipe off all the recording heads 2000 by the two cycles (two rotations) of the wiper holder 9. Further, at the time that the wiper rotation shaft 5 is rotated in order to wipe off the discharge port surface 2020, each of the wiper blades 10 is brought into being contact with (sliding on) the blade cleaner 17. Then, ink or other foreign particles which have adhered to each of the wiper blades 10 can be removed. In this manner, the wiper blades 10 are kept always clean in wiping off the discharge port surface of the recording head 2000.

Also, clear from the structure and operation represented in FIGS. 13A to 13C, the rotational center of the elevation of the wiper unit 302.is arranged to be coaxial with the axial center of the swing shaft 6 which serves as one of the supporting shafts to transmit the rotation of the wiper blades 10. As a result, it becomes possible to make the elevation of the wiper blades 10 compatible with the transmission of the rotational drive of the wiper blades. In other words, the swinging is effectuated for the elevation of the wiper unit 302 with the supporting shaft (swing shaft 6) of the wiper gear B3 which is arranged to serve as the center of rotation. Therefore, the engagement between the wiper gear B3 and the wiper gear C4 is maintained at all times, hence making the drive transmission for the elevation of the wiper blades 10 (elevation resulting from swinging) compatible with the drive transmission for the rotation (rotation needed for wiping).

Then, when the wiping operation of the recording head 2000 is completed, the CPU controls the drive switch over clutch for use of the wiper elevation, and also, controls the stepping motor 1 serving as the driving source, thus rotating the elevation cam 13 to release the contact between the guiding surface 210 and the contact roller 11. At the same time, the contact between the wiper blade 10 and the recording head 2000 is released to return to the state as represented in FIG. 13A. In this state, the carriage 200 is freed so that it can perform its recording operation and various other operations to follow.

Now, the description will be made of the amount of approach of the wiper blades 10 in a case where the distance between OH (distance between each sheet (object) and the head) is adjusted constantly when recording is made on a recording medium having different thickness, which necessitates the height of the carriage 200 to be switched over appropriately.

Figure 14:
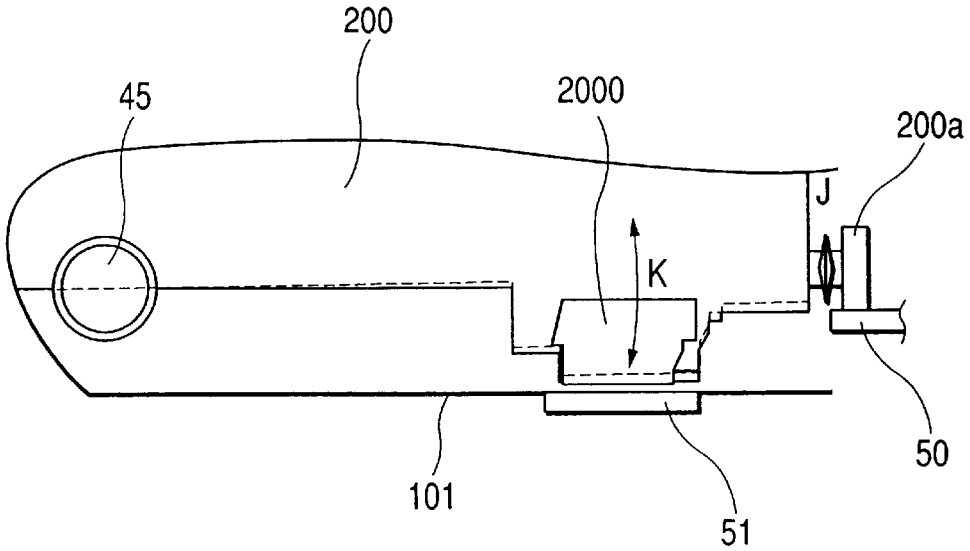
FIG. 14 is a view which schematically shows the state of the height adjustment of the carriage.

FIG. 14 is a partial side view which schematically shows the state of the height switch over of the carriage 200. In FIG. 14, the carriage 200 maintains the distance (OH distance or distance between each sheet and the head) at a specific value. Here, the distance is the gap between a recording medium (recording sheet) 101 on a platen 51 and the discharge port surface of the recording head 2000, and such specific value is maintained by guiding and supporting (hangingly installing) the carriage by means of the carriage shaft 45 and the stay (guide rail) 50. If the thickness of sheet serving as a recording medium 101 changes, the OH distance changes accordingly. To maintain this OH distance constantly, there is provided a switch over mechanism to adjust the height of the carriage 200. This height switch over mechanism is structured to switch over the OH distance in such a manner that a carriage roller 200*a* is fixed to the carriage 200, and at the same time, the rotation shaft (not shown) of the carriage roller 200*a* is caused by adjustment means (not shown) to shift in the direction indicated by an arrow J in FIG. 14 with respect to the carriage 200, and that the carriage 200 (recording head 2000) is caused to swing in the direction indicated by an arrow K in FIG. 14 centering on the carriage shaft 45 so as to move the discharge port surface vertically.

Figure 15A:
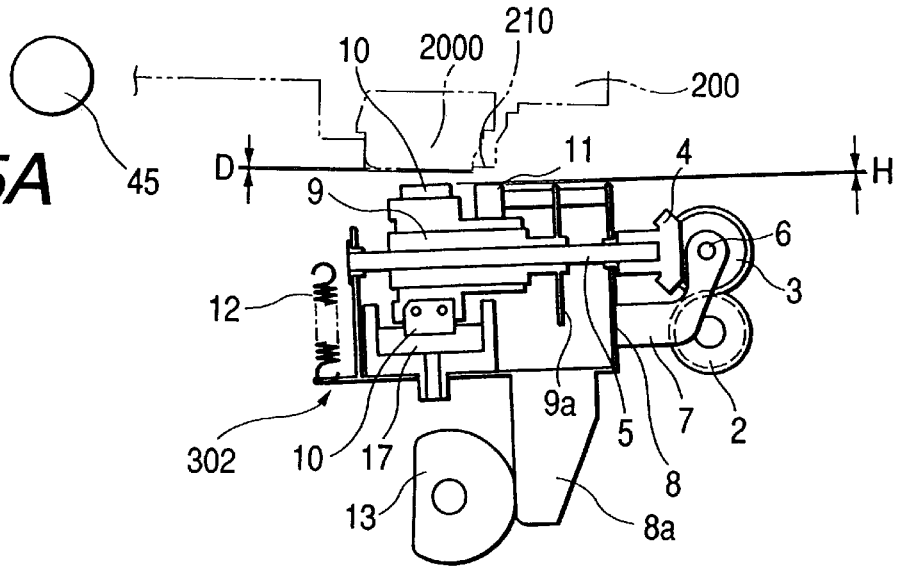
FIGS. 15A, 15B and 15C are side views which illustrate schematically the approach amount adjustment mechanism arranged for the wiper, and the respective states of the adjustment operation thereof with respect to the carriage whose height has been adjusted.
Figure 15B:
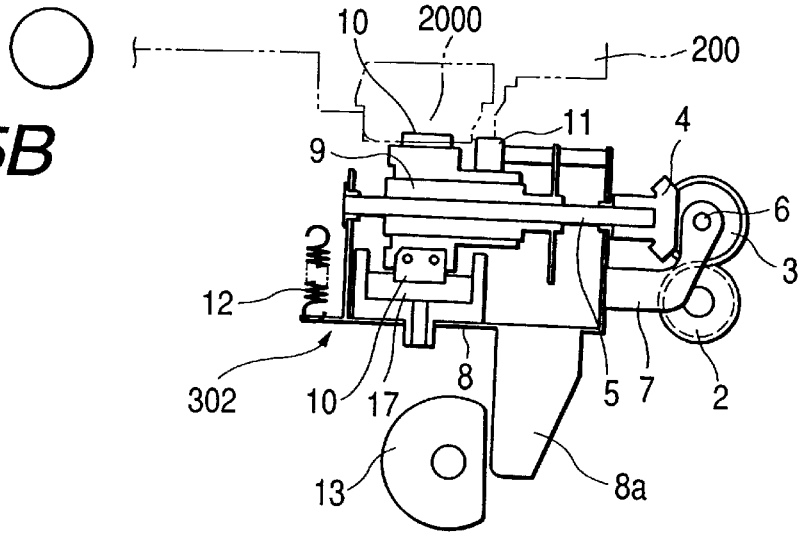
Figure 15C:
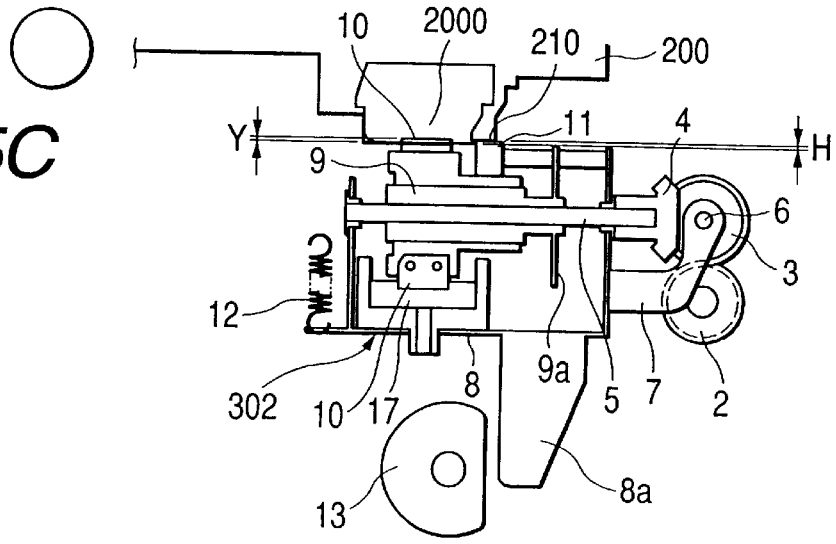

FIGS. 15A to 15C are views which illustrate the operation of the wiper unit 302 on the same section of FIGS. 13A to 13C when the height of the carriage 200 is switched over.

Now, with reference to the FIGS. 15A to 15C, the description will be made of the amount of approach of the wiper blades to the discharge port surface 2020 of the recording head 2000. FIG. 15A shows the state where the OH distance is adjusted appropriately to record on a recording medium (recording sheet) which is thicker than such distance by D by raising the carriage 200 (recording head 2000) upward by a distance D from the state shown in FIG. 13A. In a state where the carriage 200 is raised, the guiding surface arranged for the carriage is also raised by the distance D.

Therefore, in the same way as has been described in conjunction with FIGS. 13A to 13C, the contact roller 11 abuts upon the guiding surface 210 of the carriage 200. Then, the amount of the approach Y of a wiper blade 10 to the discharge port surface is determined. In this case, the difference in the height (distance) H between the upper surface of the contact roller 11 and the leading end of the wiper blade 10 is always constant even if it is switched over to the height of the carriage 200. As a result, even when the height of the guiding surface 210 changes, the distance to the wiper blade 10 from the guiding surface 210, which is made the basis of such distance, does not change at all. The amount of approach U of the wiper blade 10 in FIG. 15C and the amount of approach (appropriate amount of approach) X in FIG. 13C are made equal, and kept constant at all times. In this manner, the wiping performance is stabilized when wiping is performed.

Figure 16:
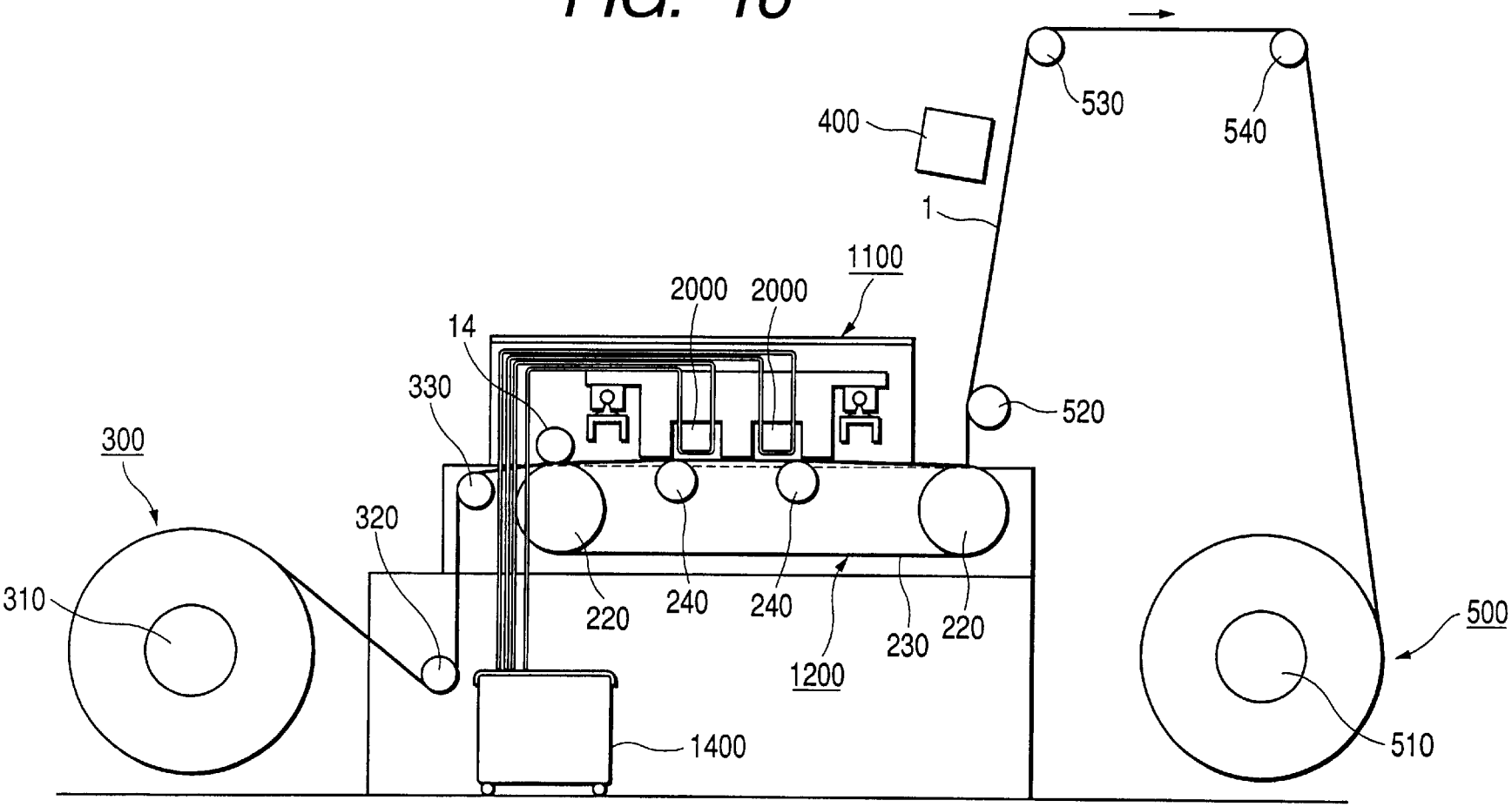
FIG. 16 is a side view which schematically shows one example of the ink jet apparatus to which the present invention is applicable.

FIG. 16 is a side sectional view which shows schematically the structure of the printing system as one example of the image formation apparatus (ink jet printer) to which the cleaning device is applicable in accordance with the present invention. Here, a reference numeral 1 designates a recording sheet serving as a printing medium, which is unrolled in accordance with the rotation of an unrolling roller 310 driven by a motor (not shown), and reaches carrier means 1200 through intermediate rollers 320 and 330. The recording sheet is carried by the carrier means 1200 substantially in the horizontal direction. After that, it is rolled by the rolling roller 500 via a carrier roller 14, intermediate roller 520, 530, and 540.

Figure 17:
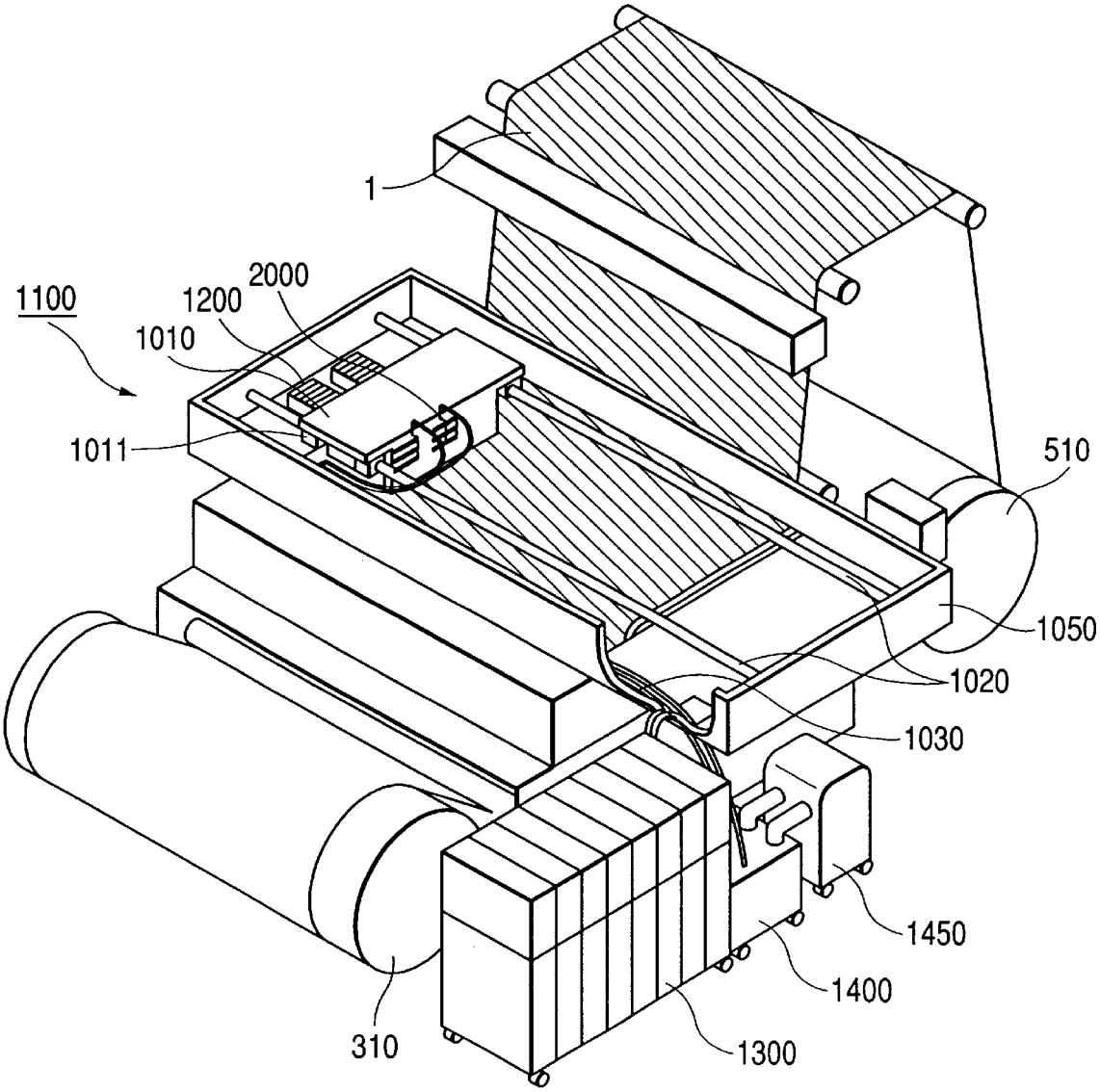
FIG. 17 is a perspective view which schematically shows one example of the ink jet apparatus to which the present invention is applicable.

FIG. 17 is a view which schematically shows the entire body of the present embodiment in accordance with the present invention. Here, a pair of guide rails 1020 are arranged in the interior of the printer frame 1050 in parallel to each other in the main scanning direction which is orthogonal to the carrying direction of the recording sheet 1. On the guide rails 1020, is mounted a head carriage 1010 through ball bearings 1011. Thus, the structure is arranged to enable the head carriage 1010 to reciprocate in the main scanning direction. In this respect, the head carriage 1010 is driven by a driving motor (not shown) fixed to one side wall of the printer frame 1050 through a driving belt (not shown). Also, on the lower end of the interior of the head carriage 1010, a recording head unit (not shown) is installed for the formation of images on the recording sheet 1.

For the head unit, there are arranged the recording head, which is provided with a plurality of ink discharge ports in a specific direction, and the one provided with a plurality of ink discharge ports in a direction different from the specific direction as a set, and also, in accordance with the present embodiment, this set of recording heads (hereinafter, may be simply referred to as a head in some cases) 2000 is held in two stages in the carrying direction. Each set of the recording heads 2000 is provided with plural heads as a set corresponding to different colors of ink, respectively. In this way, color printing is made possible. The recording head 2000 is structured in such a manner that various kinds of ink are supplied from a plurality of ink reservoir tanks 1300, which is arranged as required, to the heads through each of the relay tubes 1030 which serve as ink supply paths. The details of the ink supply paths will be described later, but since the ink supply paths should move as the head carriage 1010 moves, these paths are arranged in a caterpillar (not shown) in order to make its movement easier, and at the same time, to prevent them from being damaged.

It is preferable to use for the tubes of the ink supply paths, such as fluoro rubber, isopropylene, silicone rubber, or some other rubber, teflon or some other fluoro resin, polyolefine, polyethylene, vinyl chloride, or some other plastic material. However, the materials are not necessarily limited to those mentioned here. Also, below the home position of the recording head unit, capping means 1200 is arranged. The capping means 1200 is in contact with the discharge aports of each recording head 2000 when printing is not in operation. Each of the recording heads 2000 moves to the home position that faces the capping means 1200 for being capped when printing is not in operation. If the recording heads are left intact in the air for a long time, ink in each of the nozzles is evaporated to make ink to be overly viscous. As a result, discharges of ink may become unstable. To prevent this from taking place, the nozzle unit is cut off from the air outside and airtightly closed (capped) when printing is not in operation. In the interior of the cap, there is provided a liquid absorbent which is moisturized by ink, hence maintaining the interior of the cap in a highly moisturized condition to minimize the increase of ink viscosity.

Figure 18:
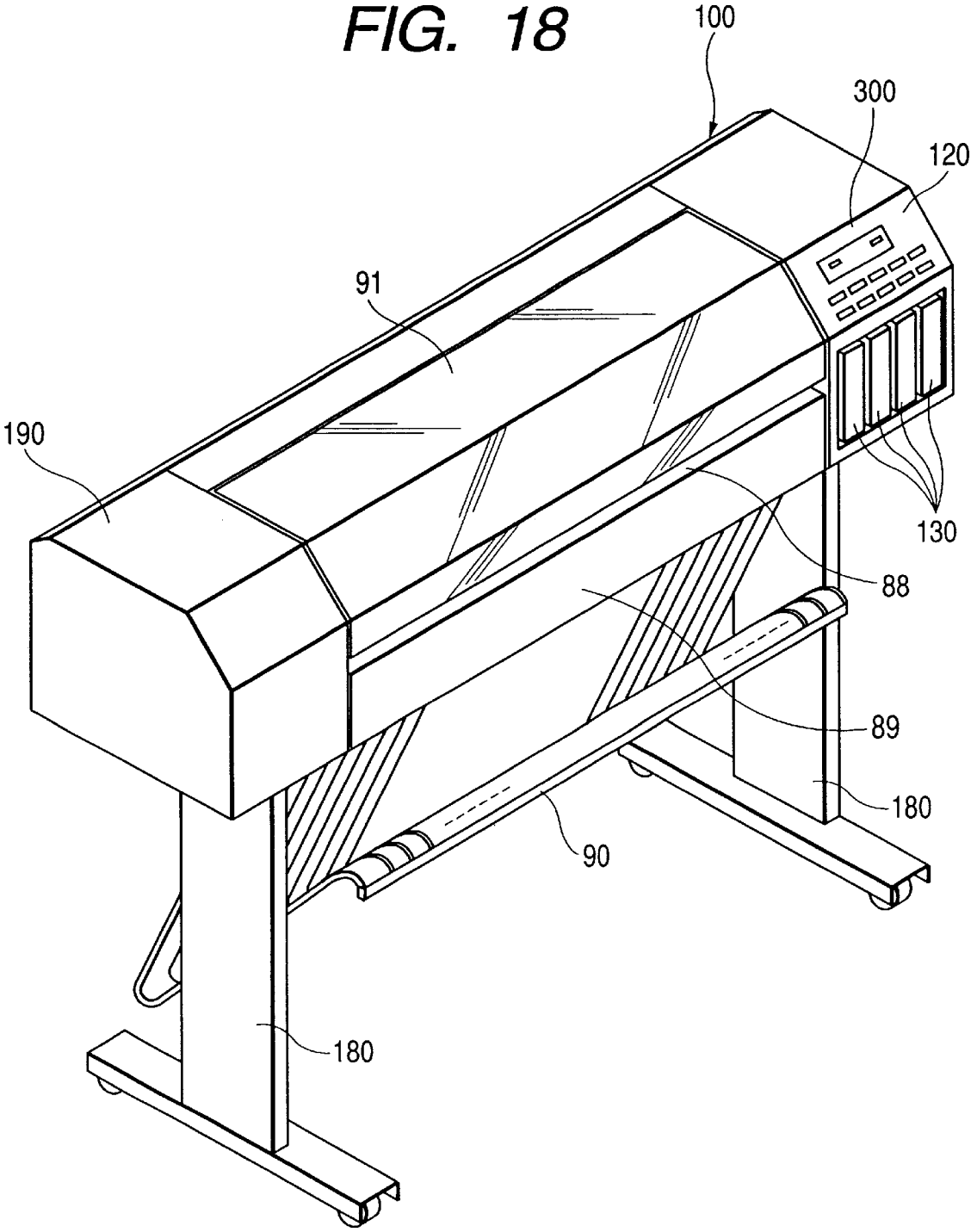
FIG. 18 is a view which schematically shows the external appearance of another example of the ink jet apparatus to which the present invention is applicable.
Figure 19:
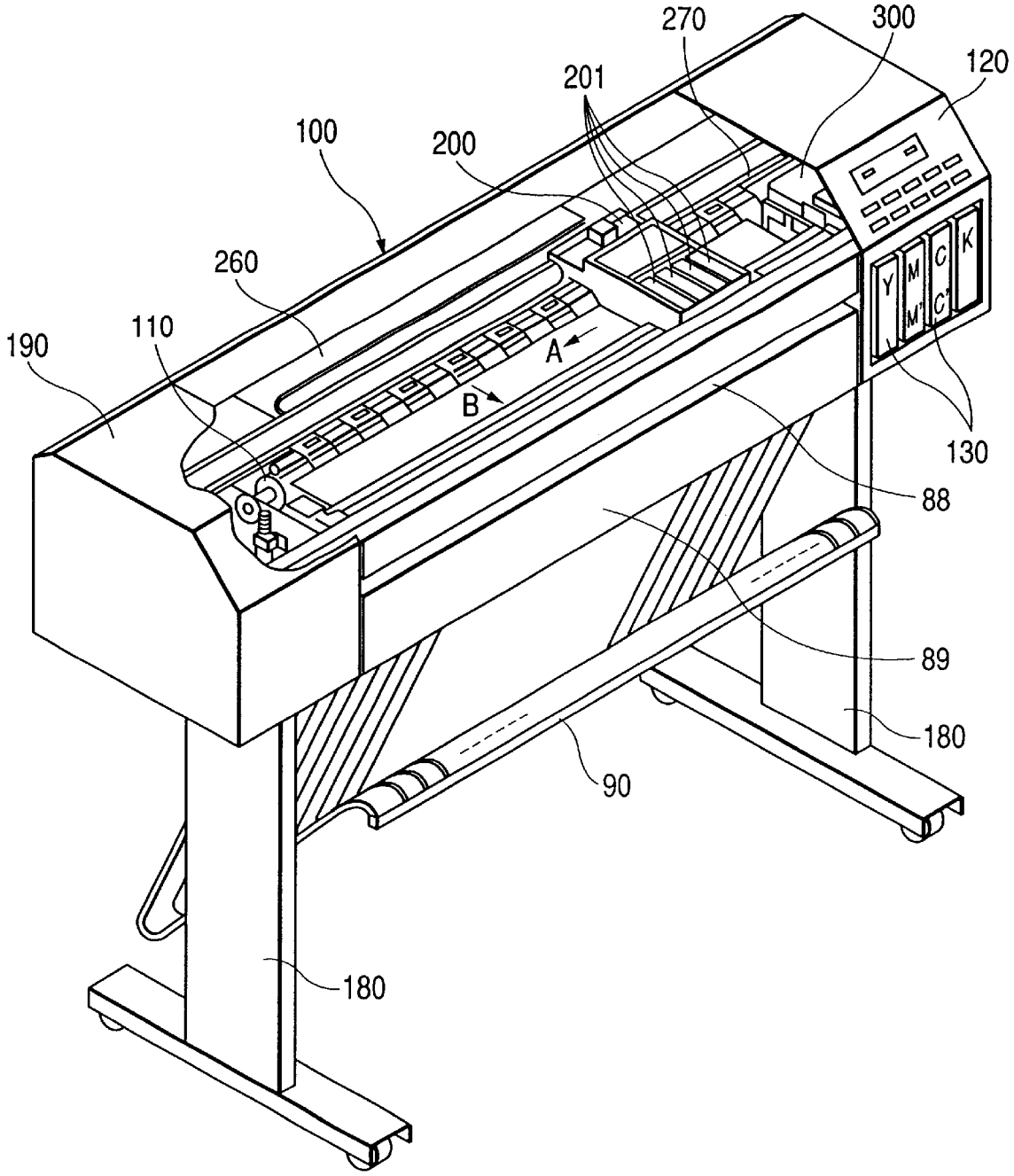
FIG. 19 is a partially'sectional view which shows another example of the ink jet apparatus to which the present invention is applicable.

FIG. 18 is a perspective view which shows the outer appearance of another example of an ink jet recording apparatus. FIG. 19 is a perspective view which shows the ink jet recording apparatus represented in FIG. 18 in a state where its upper cover is removed. In FIG. 18 and FIG. 19, a manual insertion opening 88 is arranged on the front side of the ink jet apparatus 100. Below the insertion opening, is arranged a roller unit 89 which can be open or closed toward the front side. A recording medium, such as recording sheet, is supplied from the manual insertion inlet 88 or from the roller unit 89 to the recording unit. The ink jet apparatus 100 is provided with the apparatus main body 190 supported by two foot portions 180, and the transparent upper cover 91 through which the interior of the apparatus is observable, and which can be open or closed. On the right side of the apparatus main body 190 in FIG. 18 and FIG. 19, an operation panel 120, a supply and recovery unit 300, and an ink tank 130 are arranged.

In FIG. 19, the ink jet recording apparatus 100 further comprises a pair of carrier rollers 110 to carry the recording medium such as a recording sheet in the direction indicated by an arrow B (sub-scanning direction); a carriage 200 which is guided and supported to be able to reciprocate in the width direction of the recording medium (in the direction indicated by an arrow A, that is, the main scanning direction); a carriage motor (not shown) that drives the carriage 200 to reciprocates in the direction indicated by the arrow A, and a power transmitting belt means 270; the recording head 201 which is mounted on the carriage 200 as recording means; a sub-tank 501 (refer to FIG. 20) serving as an ink reservoir means mounted on the carriage 200; and the supply and recovery unit 300 of suction type, which supplies ink to the sub-tank 501, and at the same time, eliminates defective ink discharges due to clogging of discharge ports of the recording head 2000.

In accordance with the ink jet recording apparatus shown in FIG. 19, a plurality of recording heads 2000 are mounted on the carriage 200 to perform color recording on a recording medium. The plural recording heads 2000 comprise six recording heads corresponding to each of different colors, for example. These are, for example, a head for use of Y (yellow) ink; a head for use of M (magenta); a head for use of C (cyan); a head for use of Bk (black); a head for use of light C (light cyan); and a head for use of light M (light magenta). With the structure thus arranged, recording is performed on a recording medium. In this case, the pair of carrier rollers 110 carry the recording medium to a specific recording position. Then, recording is made on the entire area of the recording medium with repetition of the main scanning by the recording head 2000 and the sub-scanning by the carrier rollers 110.

In other words, when the carriage 200 moves in the direction indicated by the arrow A in FIG. 19 by use of the carriage belt 270 and the carriage motor (not shown), recording is performed on the recording medium. When the carriage 200 returns to the position before its main scanning, the recording medium is carried by the pair of the carrier rollers 110 in the sub-scanning direction (direction indicated by the arrow B in FIG. 19). After that, the carriage 200 again performs its main scanning in the direction indicated by the arrow A in FIG. 19 to record images, characters, or the like on the recording medium. The operation described above is repeated to finish recording on one sheet portion of the recording medium. Then, the recording medium is exhausted onto the stacker 90, thus one-sheet recording is completed. In this respect, the term "recording sheet" referred to in the description given below is meant to indicate one example of the recording media including thin plastic sheet, cloth, or the like.

Figure 20:
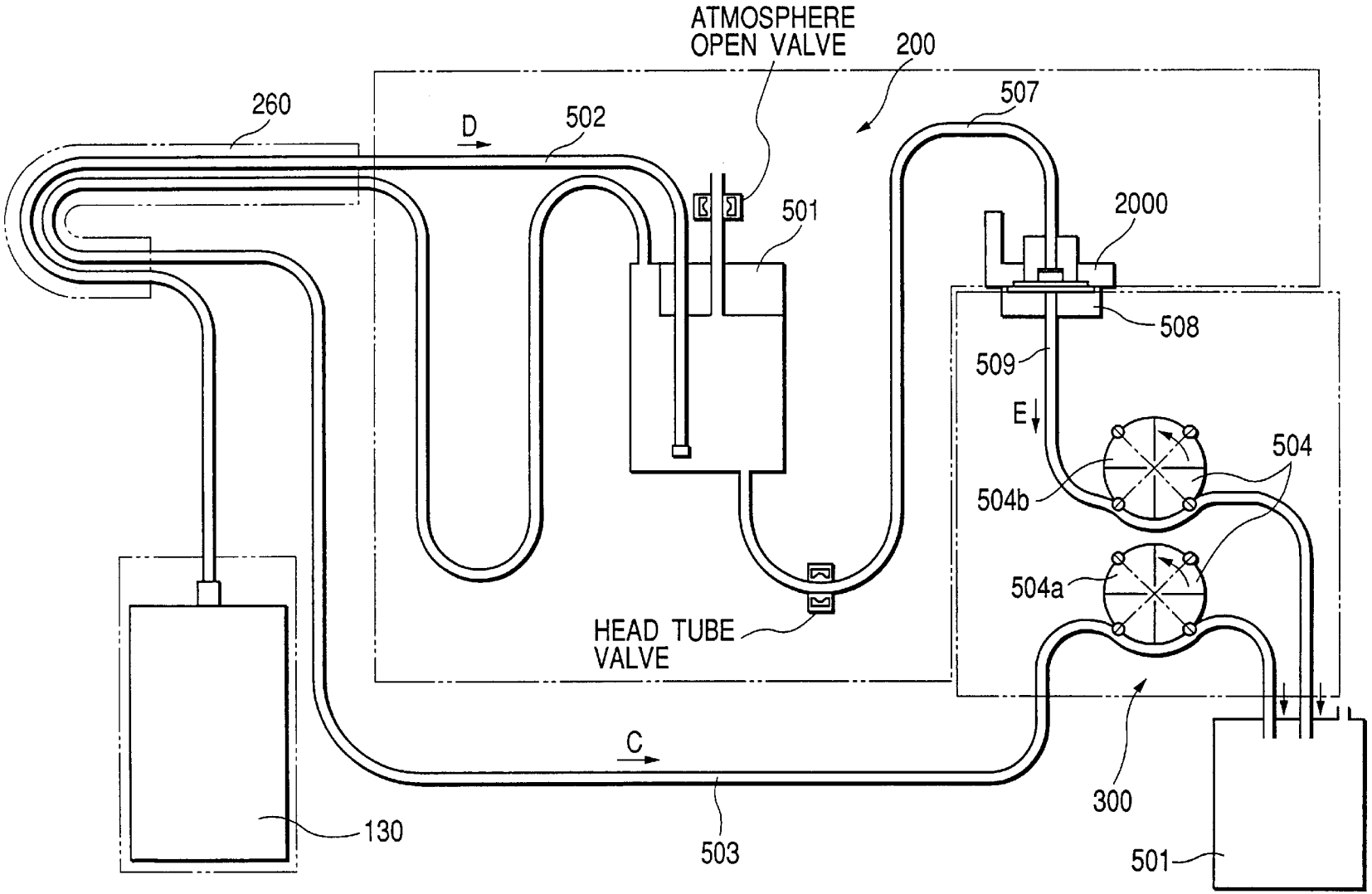
FIG. 20 is a view which schematically shows the another example of the ink supply structure of the ink jet apparatus to which the present invention is applicable.

FIG. 20 is a view which shows the ink flow paths of an ink jet recording apparatus. In FIG. 20, a plurality of sub-tanks 501 are arranged for the carriage 200 corresponding to plural ink colors used by a plurality of recording heads 2000. Each of the sub-tanks 501 is connected with each of the corresponding ink tanks 130 through a single ink.tube 502, respectively. By way of each of the ink tubes 502, ink is supplied from each of the ink tanks 130 to each of the corresponding sub-tanks 501. Each of the sub-tanks 501 is connected with the negative pressure generating means of the supply and recovery unit 300 through each of the suction tubes 503. In accordance with the example shown in FIG. 20, a tube pump 504 is used as the negative pressure generating means, which generates negative pressure by changing the volume of the flexible tube to send out ink. In accordance with the example shown in FIG. 20, there are used different tube pumps: one is the supply tube pump 504*a* that enables the suction force to act through the suction tube 503 so that ink is supplied from the ink tank 130 to the sub-tank 501 through the ink tube 502; and the other is the suction recovery tube pump 504*b* that sucks ink from the discharge ports of the recording means 2000, and at the same time, induces ink in the sub-tank 501 into the recording head 2000 through the head tube 507. The ink tube 502 and the suction tube 503 are all bundled together by means of a caterpillar 260 so as to prevent them from being disordered when the carriage reciprocates.

In accordance with the ink jet recording apparatus described above, the discharge port surface (the front end where the discharge ports are arranged) is capped by the cap 508 in order to prevent the discharge ports of the recording head 2000 from being clogged so that the recording quality is not degraded. In the capped status, the interior of the cap 508 is negatively pressurized by operating the aforesaid negative pressure generating means. Then, the suction recovery is performed to suck ink from the discharge ports, and at the same time, induce new ink into the discharge ports. The wasted ink sucked out into the interior of the cap is transferred to the waste ink tank 510 through the cap tube (waste ink tube) 509.

During recording or after the performance of the suction recovery, the circumferential edges of discharge ports are wet due to ink droplets adhering to them. In some case, ink discharged from the discharge ports may be pulled by such ink that have adhered to the discharge port surface to cause defective recording (twisting) due to the fact that ink discharges are directed unstably. In order to eliminate a defective recording of the kind, the circumferential edges of the discharge ports (discharge port surface) should be wiped off (wiped off for cleaning) exactly, thus removing the ink that has adhered to them.

Now, with reference to FIG. 20, the description will be made of the suction recovery operation. In FIG. 20, the cap (head cap) 508 covers the discharge port surface, and arranged for each of the recording heads 2000 one to one. When recording is not in operation, while the carriage 200 is in the home position (on the right side of FIG. 19), the cap 508 is caused to be in contact with (abut upon) the recording head 2000 by use of elevation means (not shown), thus capping the recording head. In this manner, ink in the ink discharge ports of the recording head 2000 is prevented from causing defective discharges due to the evaporation of in the discharge ports that may result in making ink overly viscous or solidified. Each of the caps 508 is connected with the tube pump 504*b* for use of suction recovery through the cap tube 509.

In the capping state as described above, ink sucked from the recording head 2000 flows in the direction indicated by an arrow E in FIG. 20 through the cap tube 509 when the tube pump 504*b* for use of suction recovery is driven, hence making it possible to recovery the disabled ink discharges due to clogging of the discharge ports or the like. At the same time, ink in the sub-tank 501 is caused to flow into the recording head 2000 through the head tube 507, enabling the recording head 2000 to execute recording with the ink filled in it. The downstream sides (exhaust sides) of the tube pump 504*a* for use of ink supply and the tube pump 504*b* for use of suction recovery are connected with the waste ink tank 510. All the ink that has been sucked is transferred to the waste ink tank 510.

In accordance with the present invention, it becomes possible to wipe only the required portion of the head without wiping the sealant on it, while maintaining the free length of the wiper, the overlapping amount with respect to the head, and the preferable relative speed between the head and the wiper for wiping, respectively. In this way, the stabilized wiping is always possible to keep the head surface in an appropriate condition of ink discharges, hence obtaining images in beautiful print quality with the stable ink discharges.

As clear from the description which has been made as above, the amount of ink absorbed by the blade cleaner is made smaller, and its volume is not made larger. Then, with a simpler structure, a long-term cleaning performance can be secured to make it possible to keep the wiping performance at a higher level stably for a long time when the head is wiped off. In this way, it becomes possible to provide the cleaning unit and the ink jet recording apparatus which are capable of eliminating the defective recording reliably.

Also, it is clear from the description which has been made as above, the amount of approach of each wiper blade to recording means is obtainable stably in an appropriate value in a high precision, and also, the amount of approach of each wiper blade can be secured constantly with respect to the switching over of the carriage heights. As a result, it becomes possible to implement the wiping whereby to reliably remove the ink that has adhered to the discharge port surface of the recording head, and to provide an ink jet recording apparatus capable of eliminating the degradation of image quality due to defective discharges. Also, in accordance with the present invention, the structure is arranged so that the aforesaid rotation means and elevation means can be driven by use of drive switch over means having one and the same driving source. As a result, the aforesaid effect can be attained more efficiently.

What is claimed is:

1. An ink jet printer comprising a wiper member for wiping a surface of an ink jet recording head, said ink jet recording head and said wiper member moving in the same direction of each other to wipe the surface of said ink jet recording head by one operation, wherein when said ink jet recording head and said wiper member move, wiping is performed by the difference in the relative speeds thereof, wherein said wiper member performs wiping by a rotational operation in the process of wiping, and wherein said printer is structured to enable said ink jet recording head and said wiper member to move in the same direction, while having difference in speeds thereof, and the moving speed of said wiper member is faster than the moving speed of said ink jet recording head.

2. An ink jet printer according to claim 1, wherein said printer comprises a plurality of ink jet recording heads and a plurality of said wiper members.

3. An ink jet printer according to claim 1, wherein said wiper member is formed by ether polyurethane.

4. An ink jet printer according to claim 1, wherein said wiper member is formed by polyethylene terephthalate.

5. An ink jet printer according to claim 1, wherein said wiper member is formed by foaming member.

6. An ink jet printer comprising a wiper member for wiping a surface of an ink jet recording head, said ink jet recording head and said wiper member moving in the same direction of each other, the moving speed of said wiper member being arranged to be faster than the moving speed of said ink jet recording head for wiping the surface of said ink jet recording head by one operation of said wiper member, and a cleaning mechanism being provided for cleaning said wiper member, wherein when said ink jet recording head and said wiper member move, wiping is performed by the difference in the relative speeds thereof wherein said wiper member performs wiping by a rotational operation in the process of wiping, and wherein said printer is structured to enable said ink jet recording head and said wiper member to move in the same direction, while having difference in speeds thereof, and the moving speed of said wiper member is faster than the moving speed of said ink jet recording head.

7. An ink jet printer according to claim 6, wherein said cleaning mechanism has a positional relation with said wiper member so as not to allow said mechanism to function during said wiper member performs wiping.

8. An ink jet printer provided with a wiper member for wiping a surface of an ink jet recording head, comprising:

at least one recording head having sealant on both sides of the surface surrounding a nozzle array, and being movable in the direction at right angles to said sealant; and at least one rotational wiper member having its leading end to move in the same direction as said recording head for wiping nozzle array without contacting with said sealant, said nozzle array being wiped by one operation of said wiping member.

9. An ink jet printer according to claim 8, wherein a plurality of recording heads are arranged in the moving direction thereof, and a plurality of wiping members are arranged at a predetermined interval in the radial direction from a rotation shaft thereof, and each of said wiper members rotates during the movement of each of said recording heads for wiping each of the corresponding recording heads by one wiping operation of each of said wiping members.

10. An ink jet printer according to claim 9, wherein said wiper member is formed by one wiper or two wipers arranged with a gap therebetween.

11. An ink jet printer according to claim 9, further comprising:

cleaning means arranged within a rotation locus of the leading end of said wiper member for removing an ink droplet and others adhering to the leading end of said wiper member.

12. An ink jet printer according to claim 11, wherein said cleaning means comprises scrape means for scraping the ink droplet and others adhering to the leading end of said wiper member or suction means for sucking the ink droplet and others adhering the leading end of said wiper member or both.

13. An ink jet printer according to claim 9, wherein said cleaning means is not in contact with any one of said wiping members during any one of the plural wiping members wipes any one of said recording heads.

14. An ink jet recording apparatus provided with a wiper blade for wiping a discharge port surface of recording means for recording by discharging ink to a recording medium, comprising:

a first blade cleaner and a second blade cleaner for said wiper blade to contact therewith after wiping said discharge port surface, wherein the first and second blade cleaners are present in a turning path of the wiper blade, wherein a plurality of said wiper blades are arranged radially centering on a rotation shaft thereof, and wherein said first and second blade cleaners are not in contact with any one of said wiper blades during said discharge port surface is wiped.

15. An ink jet recording apparatus according to claim 14, wherein said first blade cleaner scrapes off significantly ink adhering to said wiper blade, and said second blade cleaner collects remaining ink on said wiper blade after the wiper blade contacts with said first blade cleaner.

16. An ink jet recording apparatus according to claim 14, wherein said first cleaner is formed by material having low ink absorptivity.

17. An ink jet recording apparatus according to claim 14, wherein a contact surface of said first blade cleaner with said wiper blade is in a stepping form.

18. An ink jet recording apparatus according to claim 14, wherein said second blade cleaner is formed by material having high ink absorptivity.

19. An ink jet recording apparatus according to claim 14, wherein said wiper blade wipes the discharge port surface of recording means by being rotated with respect to said recording means.

20. An ink jet recording apparatus according to claim 14, wherein said wiper blade is in contact with said first blade cleaner and said second blade cleaner during one cycle.

21. A cleaning unit provided with a wiper blade for wiping a discharge port surface of recording means for recording by discharging ink to a recording medium, comprising:

a first blade cleaner and a second blade cleaner for said wiper blade to contact therewith after wiping said discharge port surface, wherein the first and second blade cleaners are present in a turning path of the wiper blade, wherein a plurality of said wiper blades are arranged radially centering on a rotation shaft thereof, and wherein said first and second blade cleaners are not in contact with any one of said wiper blades during said discharge port surface is wiped.

22. A cleaning unit according to claim 21, wherein said first blade cleaner scrapes off significantly ink adhering to said wiper blade, and said second blade cleaner collects remaining ink on said wiper blade after its contact with said first blade cleaner.

23. A cleaning unit according to claim 21, wherein said first cleaner is formed by material having low ink absorptivity.

24. A cleaning unit according to claim 21, wherein a contact surface of said first blade cleaner with said wiper blade is in the stepping form.

25. A cleaning unit apparatus according to claim 21, wherein said second blade cleaner is formed by material having high ink absorptivity.

26. A cleaning unit according to claims 21, wherein said wiper blade wipes the discharge port surface of recording means by being rotated with respect to said recording means.

27. A cleaning unit according to claim 21, wherein said wiper blade is in contact with said first blade cleaner and said second blade cleaner during one cycle.

28. An ink jet recording apparatus for recording by discharging ink from recording means to a recording medium, and a discharge port surface of recording means thereof being wiped by a rotation of a plurality of wiper blades in the moving direction of said recording means, comprising:

rotation means for rotating the wiper blades;

elevation means for elevating a wiper unit by swinging;

a contact member being in contact with a guiding surface of a carriage; and bias means for biasing said contact member to said guiding surface, a swinging center of said wiper unit being arranged to be coaxial with an axial center of one rotation shaft of said rotation means.

29. An ink jet recording apparatus according to claim 28, wherein said rotation means and said elevation means are driven by means of drive switch over of one and the same driving source.

* * * * *

UNITED STATES PATENT AND TRADEMARK OFFICE

CERTIFICATE OF CORRECTION

PATENT NO. : 6,352,334 B2
DATED : March 5, 2002
INVENTOR(S) : Tatsuya Fukushima et al.

It is certified that error appears in the above-identified patent and that said Letters Patent is hereby corrected as shown below:

Title page,
Item [56], References Cited, FOREIGN PATENT DOCUMENTS, "57034969" should read -- 57-034969 --;
"62113554" should read -- 62-113554 --; and
Item [57], ABSTRACT,
Line 3, "each" should read -- as each --.

Column 5,
Line 16, "each" should read -- as each --; and
Line 22, "each" should read -- as each --.

Figures 2, 8:
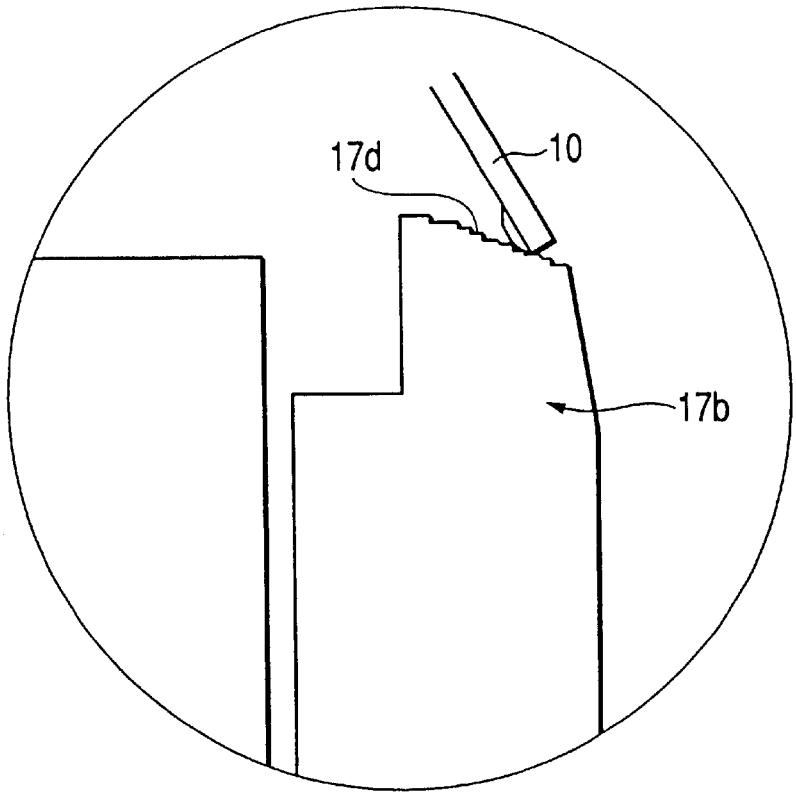

Column 6,
Line 34, "FIGS. 7A, 7B, 7C" should read -- FIGS. 7A-1, 7A-2, 7B-1, 7B-2, 7C-1, 7C-2 --; and
Line 37, "FIG. 8 is a view" should read -- FIGS. 8-1 and 8-2 are views --; and "shows" should read -- show --.

Column 10,
Line 10, "portion-of" should read -- portion of --.

Column 12,
Line 35, "FIGS. 7A" should read -- FIGS. 7A-1 --;
Line 42, "FIG. 7A," should read -- FIG. 7A-2, --; and
Line 54, "leader circle of FIG. 7C." should read -- enlarged view in FIG. 7C-2, --.

Column 13,
Line 47, "FIG. 8," should read -- FIG. 8-1, --;
"view" should read -- view in FIG. 8-2, --; and
"in the leader" should be deleted; and
Line 48, "circle," should be deleted.

Column 19,
Line 9, "aports" should read -- ports --.

UNITED STATES PATENT AND TRADEMARK OFFICE

CERTIFICATE OF CORRECTION

PATENT NO. : 6,352,334 B2
DATED : March 5, 2002
INVENTOR(S) : Tatsuya Fukushima et al.

It is certified that error appears in the above-identified patent and that said Letters Patent is hereby corrected as shown below:

Column 21,
Line 20, "of" should be deleted.

Column 22,
Line 56, "during" should read -- when --.

Signed and Sealed this

First Day of April, 2003

JAMES E. ROGAN
*Director of the United States Patent and Trademark Office*